US009284823B2

(12) United States Patent
Kratochvil et al.

(10) Patent No.: US 9,284,823 B2
(45) Date of Patent: Mar. 15, 2016

(54) COMBINED PERFORATING AND FRACKING TOOL

(71) Applicant: IRON HORSE COILED TUBING INC., Dunmore (CA)

(72) Inventors: Robert B. Kratochvil, Calgary (CA); Brendon Hamilton, Dunmore (CA); Daniel Meier, Dunmore (CA)

(73) Assignee: IRON HORSE COILED TUBING INC., Dunmore, Alberta (CA)

( * ) Notice: Subject to any disclaimer, the term of this patent is extended or adjusted under 35 U.S.C. 154(b) by 89 days.

(21) Appl. No.: 14/183,914

(22) Filed: Feb. 19, 2014

(65) Prior Publication Data

US 2015/0233217 A1 Aug. 20, 2015

(30) Foreign Application Priority Data

Feb. 11, 2014 (CA) ..... 2842586

(51) Int. Cl.
*E21B 43/112* (2006.01)
*E21B 43/26* (2006.01)

(52) U.S. Cl.
CPC ..... *E21B 43/112* (2013.01); *E21B 43/26* (2013.01)

(58) Field of Classification Search
CPC ..... E21B 43/26; E21B 43/114; E21B 43/116; E21B 43/11852; E21B 43/112; E21B 43/118; E21B 43/11
See application file for complete search history.

(56) References Cited

U.S. PATENT DOCUMENTS 5,327,970 A * 7/1994 McQueen et al. ..... 166/278
2013/0175035 A1* 7/2013 Lee ..... 166/298

* cited by examiner

*Primary Examiner* — Zakiya W Bates
(74) *Attorney, Agent, or Firm* — Harness, Dickey & Pierce, P.L.C.

(57) ABSTRACT

A combined perforating and fracking tool, and method for using same, for perforating a hydrocarbon well casing and for subsequently fracturing the formation while maintaining the tool in situ. The combined perforating and fracking tool comprises, in a preferred embodiment, a series of connected cylinders arranged to be disposed in a well casing, each of the cylinders comprising a cooperating piston whereby a magnification of hydraulic force is generated. The series of pistons operate to actuate a punch assembly disposed at a downhole end of the series of connected cylinders to perforate the casing. A fluid injection port, in operation with at least one sealing member disposed at each end of the series of connected cylinders, allows fluid to be diverted into the formation through the perforations created in the well casing to induce fracturing in the formation.

38 Claims, 18 Drawing Sheets

135

130
140
135
130
140
135
150
120

140

150
120

10
50
205
30
40
20

50
205
H
120
10
50
Q
20
47

120
J
110
60
69''
M
69
69'

130
120
L
110
60
69''
N
69
69'

10
50
205
400
40
20
47

10
50
205
120
110
69'''
S
R
Q
40
20
47

120
J
110
60
90
69'''
438
T
40

120
L
110
90
69'''
438
U
40

COMBINED PERFORATING AND FRACKING TOOL

FIELD OF THE INVENTION

The present disclosure relates to the field of hydrocarbon extraction from subterranean formations and, in particular, to a combined perforating and fracking tool for hydrocarbon well completion and stimulation.

BACKGROUND OF THE INVENTION

The extraction of hydrocarbons from subterranean formations involves drilling a well and undertaking completion operations to transform the drilled well into a producing one. The completion process typically involves casing the wellbore to ensure that the well does not close in upon itself. The casing is typically steel piping that is cemented into place to line the well. In order to achieve production, the casing and cement must be perforated to allow for the flow of hydrocarbons into the wellbore, but still provide a suitable amount of support and protection for the well.

Stimulation techniques have been developed to further improve the efficiency of hydrocarbon extraction. One such technique is hydraulic fracturing ("fracking") which involves the injection of highly pressurized fracking fluids through the perforated casing and into the formation. Injection of such fluids creates small fractures/fissures that extend substantially perpendicularly outwardly from the well into the formation, through which distantly-located hydrocarbons can thereby flow into, and thus flow therealong and into the wellbore for pumping to surface.

Generally, perforating and fracking a well have involved separate processes in which a well casing is first perforated followed by the injection of high pressure fracking fluid. Processes for perforating the well casing have included, for example, running a perforation gun into the wellbore to discharge high pressure jets of fluid to penetrate the casing at various locations, or to fire "shaped" explosive charges at various intervals along the wellbore into the sides of the casing to create the perforations. Once the perforations are formed, the fracking fluid is pumped into the well to fracture the formation in the region surrounding the wellbore and preferably in outwardly extending fissures which extend perpendicularly outwardly from the wellbore. Disadvantageously, however, apart from the additional time and expense of a two step discrete process of inserting the perforating gun, perforating, and removing such perforating gun before perforating can occur, such prior art methods are further unsatisfactory, since the problem with prior art devices and methods which separately perforate the well bore with perforating "guns" which use explosive charges, withdrawing the guns, and then inserting the fracking tool, is that the fracking tool does not necessarily align with the created perforations. Such prior art methods are thus for this reason as well unsatisfactory.

Specialized tools have been described to improve the efficiency of such methods. U.S. Pat. No. 7,337,844 describes a perforating and fracturing tool that perforates the well using a jetting sub and a plurality of jets which eject high pressure fluid to perforate the well casing. The device comprises a fluid distributor which may be selectively configured to communicate high pressure fluid to supply the perforating operation or to concurrently or simultaneously communicate the high pressure fluid to supply the fracturing operation. By diverting the fluid flow, perforating and fracturing operations can be achieved while keeping the device in the wellbore.

Other tools have been described which involve mechanically perforating the well casing. U.S. Pat. No. 2,638,801 teaches a casing perforator that is attachable to a drill string in driving connection with at least one rotating drill. The casing perforator is lowered into a pipe or well casing to drill ports into the casing, and fluid under high pressure is then passed down through the drill string through the perforator and out through the drill while the drill is within the ports. Fluid is discharged through the hollow interior of the drill to hydraulic passages out into the surrounding formation. In this way, the drilling of the casing and the fracking of the formation are accomplished consecutively while maintaining the perforator in one position.

Similarly, Russian Patent No. 2069741 describes a device for mechanical perforation of wells in which a pair of hydraulically actuated puncturing units are caused to extend radially outwardly from the tool to pierce the casing. Fluid jets built within the puncturing units inject fluid through these puncturing units and into the formation to open channels therein. In this way, the device can mechanically puncture the casing while simultaneously opening channels in the formation while maintaining the device in one position.

International Patent Publication No. WO 2012/098377 describes a perforating tool that utilizes a plurality of pistons that cooperatively operate to outwardly deploy a cutter block along tracks to enable large perforations to be cut into the well casing. Once the perforations are made, the cutter block is inwardly retracted to allow the work string to be lowered in order to position a packer apparatus below the perforated section of the well casing. With the work string in this position, high pressure pumping of hydraulic fracturing fluid can be commenced to conduct a hydraulic fracturing operation.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention to provide a tool capable of providing the combined functions of both perforating and fracking of a wellbore, to avoid having to "trip-out" a perforating tool from a well in order to then be able to frack a well.

In a preferred embodiment, the tool has means, as described below, to allow lowering of the tool within the well when the well has fluid therein, and prevent passage uphole of downhole fluid when the tool is in the wellbore, where such downhole fluid typically contains sand. Such mechanisms of the tool of the present invention avoids and/or reduces the tendency of the tool to become "sanded in" within the wellbore and not able to be withdrawn therefrom after various perforating and fracking operations within the wellbore at various locations therein have been completed.

In one broad aspect of the tool of the present invention, a combined perforating and fracking tool for perforating a hydrocarbon well casing disposed in a formation, and for subsequently fracturing the formation while maintaining the tool in situ, is provided, the tool comprising:

(a) at least one cylinder arranged to be disposed in a well casing and adapted at an uphole end to receive fluid, said cylinder comprising a cooperating piston;

(b) a punch assembly disposed at a downhole end of said cylinder and co-operating piston, the punch assembly comprising a punch comprising a pointed piercing member for perforating the casing, wherein the punch assembly is actuated by the fluid exerting a pressure on the cooperating piston, and the cooperating piston exerting a force which causes outward extension of the pointed piercing member to perforate the casing;

(c) a fluid injection port disposed at an upper end of the tool to allow fluid to be injected into the formation through the perforations created in the well casing by the tool; and (d) at least one sealing member disposed proximate an upper uphole end of the cylinder, downhole of said fluid injection port, adapted to prevent fracking fluid from travelling, when such tool is in a well casing, outside the cylinder in a direction downhole;

wherein fluid may be provided in a bore defined along the longitudinal axis of the cylinder; and whereby a force is generated by fluid under pressure travelling in said bore and acting on the cooperating piston which then actuates the punch assembly to actuate, in a radially-outwardly protruding manner, said pointed piercing member to perforate the casing.

In a further refinement, the tool may comprise a plurality of sequential cylinders adapted to be disposed in a well casing and adapted at an uphole end to receive fluid, each of said cylinders comprising a cooperating piston, wherein each piston defines a bore along its longitudinal axis and an associated port for conducting fluid flow from the bore into each cylinder.

Accordingly, in a further preferred embodiment, the invention comprises a combined perforating and fracking tool for perforating a well casing disposed in an underground formation and for subsequently fracturing the formation while maintaining the tool in situ, the tool comprising:

(a) at least a pair of cylinders arranged to be disposed in a well casing and adapted at an uphole end to receive fluid, each of said cylinders comprising a cooperating piston, wherein each piston defines a bore along its longitudinal axis and an associated port for conducting fluid flow from the bore into each cylinder;

(b) a punch assembly disposed at a downhole end of the cylinders, the punch assembly comprising a punch for perforating the casing, wherein the punch assembly is actuated by a piston which outwardly extends a punch to perforate the casing;

(c) a fluid injection port disposed at the uphole end of the tool, and a valve member, to allow fluid to be diverted from the cylinders and injected into the formation through the perforations created in the well casing; and (d) at least a pair of sealing members respectively disposed respectively at an upper and lower end of the tool, forming a seal between the casing and the tool such that fluid can be diverted through the fluid injection port for fracturing the formation;

wherein the cylinders remain isolated from the injected fluid flowing between the tool and well casing during fracturing; and wherein during a perforation step fluid flowing through a bore defined along the longitudinal axis of tool sequentially fills each of the cylinders whereby a magnification of hydraulic force is generated by the cooperating pistons to actuate the punch.

In accordance with another aspect of the present invention, there is described a combined perforating and fracking tool for perforating a hydrocarbon well casing disposed in a formation, and for subsequently fracturing the formation while maintaining the tool in situ, the tool comprising:

(a) a series of connected cylinders arranged to be disposed in a well casing and adapted at an uphole end to receive fluid, the series of connected cylinders comprising:

a first cylinder comprising a valve assembly for controlling activation of the punch assembly;

a second cylinder comprising an associated piston, the associated piston in fluid connection with the valve assembly such that when the valve assembly is in an open position fluid is allowed to flow through the associated piston and associated ports to fill the second cylinder fluid pressure within the second cylinder increases to cause the associated piston to move therein;

(b) a punch assembly disposed at a downhole end of the series of connected cylinders, the punch assembly comprising a pointed punch member for perforating the casing, wherein the punch assembly is actuated by the first and second pistons to outwardly extend the punch member to perforate the casing;

(c) a fluid injection port disposed at the uphole end of the series of connected cylinders to allow fluid to be diverted from the series of connected cylinders and injected into the formation through the perforations created in the well casing; and (d) at least one sealing member disposed at each end of the series of connected cylinders, each sealing member forming a seal between the casing and the tool such that fluid can be diverted through the fluid injection port for fracturing the formation, and wherein the series of cylinders remains isolated from the injected fluid flowing between the tool and well casing;

wherein fluid flowing through the second cylinder results in a force supplied by the associated piston to actuate indirectly or directly the punch assembly.

In a particular embodiment of the above aspect the valve assembly (and in particular the first cylinder thereof) comprises a slidable sleeve having a fluid passageway, and further preferentially a "J" type sleeve to allow a plurality of up and down movements of the tool prior to actuating the slidable sleeve in the manner set out below, said slidable sleeve being slidable along a mandrel on the tool at a location on the tool having radial aperture therein, said slidable sleeve on its exterior having a friction member to consistently frictionally engage the casing, wherein when the tool is lowered to a desired position downhole, upward movement of the tool thereafter and resultant frictional engagement of said friction member with said casing causes relative movement of said slidable sleeve relative to said mandrel and thus repositioning of said passageway therein so as to then become in fluid communication with said radial aperture so as to cause such valve assembly to be in an open position and allow supply of fluid to downstream pistons to thereby allow actuation of said punch.

In such above embodiment the sealing members disposed at each of the tool (but at the upper end of the tool the associated sealing member being disposed below the fluid injection port) also, on either end of the tool, advantageously prevent fluid (and any sand entrapped therein) being introduced in the wellbore area between the tool and the casing which could otherwise cause the tool to become "sanded in". Specifically, such sealing members, preferably cup seals, are positioned and arranged on the tool so as to allow the upper seal to cause fracking fluid to flow into the formation via the created perforations in the casing during fracking and prevent such injected fluid from flowing past the tool downhole, and the lowermost cup seal prevents downhole fluids from flowing uphole past the tool during fracking and perforation operations to thereby avoid possibly entraining sand in the region of the wellbore between the tool and the wellbore, and thus the "sanding in" of the tool within the wellbore.

A selectively-operable bypass means is provided on the tool, however, to allow fluid in the wellbore which may come from perforations and fracking of the wellbore to bypass the downhole seal member so that such fluid may be displaced uphole during lowering of the tool into the wellbore. Such bypass means allows lowering of the tool in the wellbore where such lowering would otherwise be prevented by existing presence of fluid in the wellbore.

In accordance with a further aspect of the present invention, there is described a method for perforating a well casing disposed in a formation and for subsequently fracturing the formation while maintaining the tool in situ using a tool of any of the configurations described above. In accordance with such further aspect/method, such method comprises the steps of:

(a) supplying fluid to the combined perforating and fracking tool in any of the embodiments described above when such tool is disposed within a well casing, activating a valve therein so as to provide fluid flow through the series of connected cylinders and associated pistons whereby a combined force is generated by such pistons to actuate the punch assembly to form created perforations in the well casing;

(b) lowering the combined perforating and fracking tool to position the fluid injection port thereon adjacent to the created perforations in the well casing and to position the at least one sealing member downhole of the created perforations in the well casing; and (c) pumping fluid through the fluid injection port and created perforations to fracture the formation.

BRIEF DESCRIPTION OF THE DRAWINGS

These and other features of the invention will become more apparent in the following detailed description in which reference is made to the appended drawings.

DETAILED DESCRIPTION OF THE INVENTION

Definitions

Figure 1A:
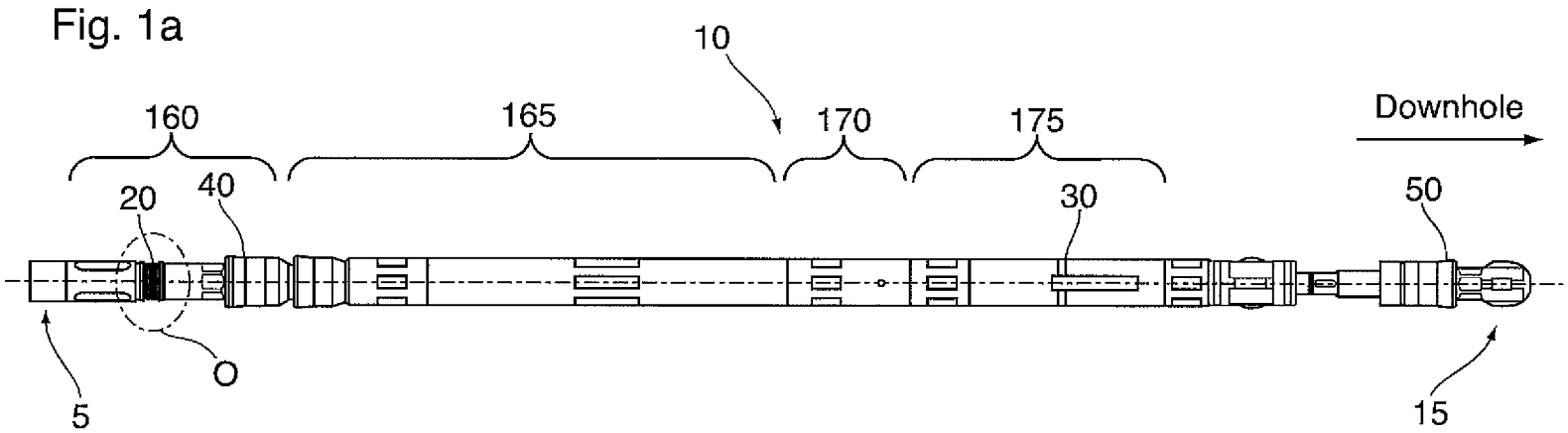
FIG. 1*a* is a side exterior view of a first embodiment of the combined perforating and fracking tool of the present invention.

Unless defined otherwise, all technical and scientific terms used herein have the same meaning as commonly understood by one of ordinary skill in the art to which this invention belongs.

As used herein, the term "hydrocarbon formation", "subterranean formation", or "formation", may be used interchangeably to refer to subterranean formations that are explored and exploited for hydrocarbon resources through drilling and extraction techniques.

As used herein, the term "about" refers to an approximately +/−10% variation from a given value. It is to be understood that such a variation is always included in any given value provided herein, whether or not it is specifically referred to.

Completing a hydrocarbon well for production typically involves perforating the well casing to enable hydraulic fracturing techniques ("fracking") to be used to facilitate the production the hydrocarbons flowing into the wellbore. Typically, perforating the well casing and fracking the formation are separately carried out using a variety of known techniques often requiring multiple tools and processes to be used. Thus, well completion can become inefficient and cumbersome to achieve.

The embodiments of the present disclosure provide in a single tool both perforating and fracking operability. By combining both functionalities in a single tool, hydrocarbon well completion can be achieved in a more efficient, reliable, and repeatable manner.

Perforating the Well Casing

Reference is to be had to FIGS. 1-29 of the drawings wherein similar components are identified with like reference numerals.

The combined perforating and fracking tool 10 of the present invention combines a fracking assembly 160, activation assembly 165, force-magnifying assembly 170, and punch assembly/mechanism 175 comprising mechanical piercing means 130 for piercing/perforating a casing of a well, all of which synergistically operate together to allow the single tool 10 to perforate and thereafter frack a well to thereby achieve well completion.

Figure 1B:
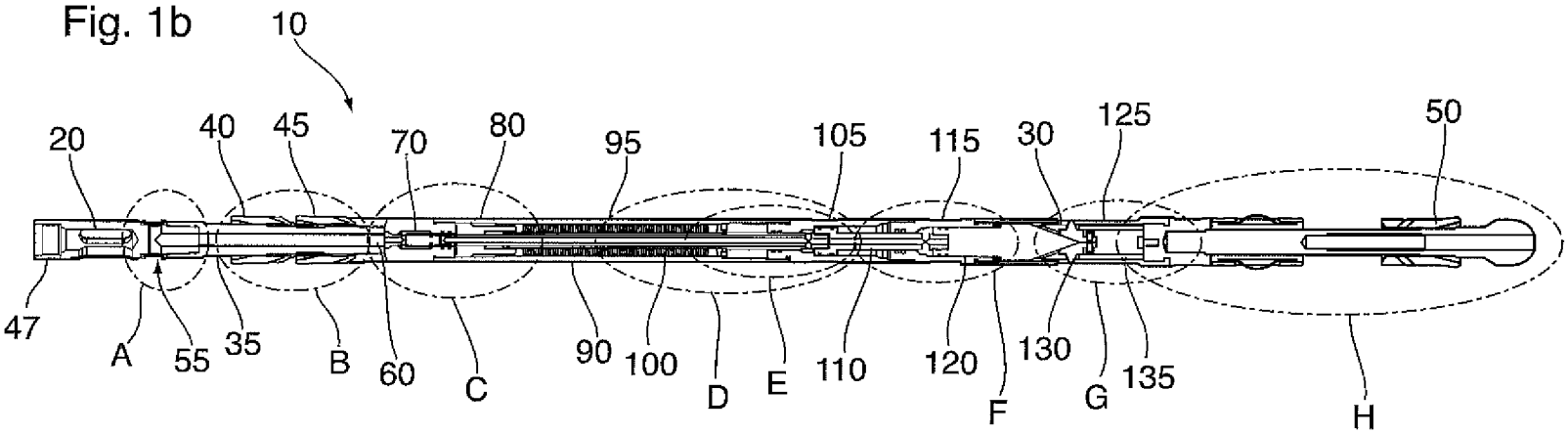
FIG. 1*b* is a longitudinal cross-sectional view of the combined perforating and fracking tool along the plane of the arrows shown in FIG. 1*a;*
Figure 2A:
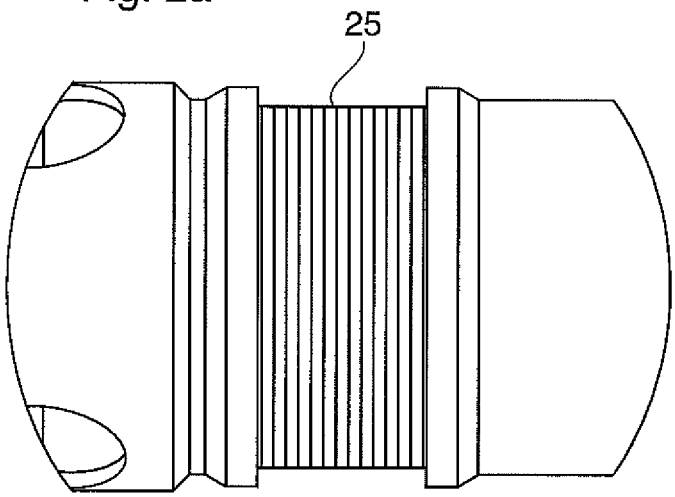
FIG. 2*a* is a close-up view of the fluid injection assembly (region "O") of the combined perforating and fracking tool shown in FIG. 1*b;*
Figure 2B:
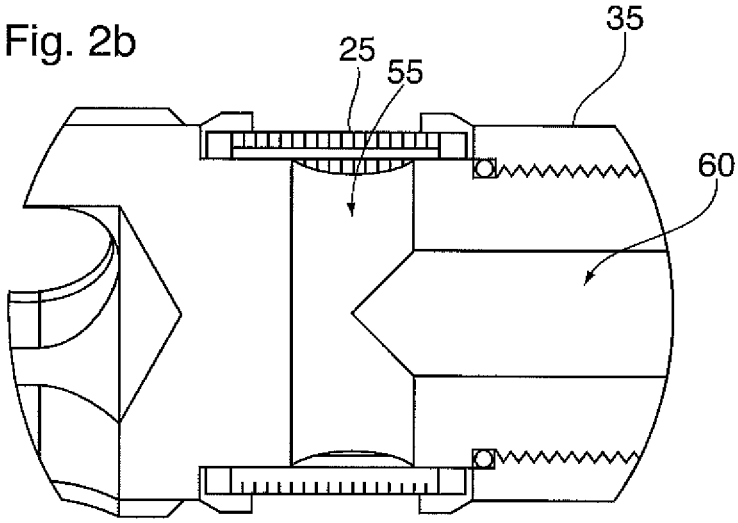
FIG. 2*b* is a longitudinal cross-sectional view of the fluid injection assembly shown in FIG. 2*a*, and is also an enlarged view of region "A" of FIG. 1*b;*

Referring to FIGS. 1*a* and 1*b*, the respective assemblies 160, 165, 170, and 175 in a preferred embodiment are arranged sequentially, in a series of connected cylinders within tool 10, to be disposed in a well casing. The tool 10 is adapted at an uphole end 5 to receive fluid and comprises a first cylinder 95 containing the activation assembly 165, and a further series of further successive cylinders, namely a second cylinder 105 forming a first stage of a magnifying assembly 170, and a third cylinder 115 that contains the punch assembly 175. As shown in FIG. 1*b*, the assemblies are sequentially arranged in fluid connection, thereby allowing the entering fluid to flow through each cylinder whereby a magnification of hydraulic force is generated to actuate the punch assembly 175 to form perforations (not shown) through a well casing (not shown).

At the uphole end 5 of the tool 10, the activation assembly 165 is comprised of a valve assembly 69 that operates to control activation of the perforating function of the tool 10. In one embodiment of valve assembly 69 shown in FIG. 3*a*, the valve assembly 69 comprises a valve stem 70 over which is a sliding sleeve 71 which is operatively connected to a first (activating) piston 80, which is biased to the (closed) position shown in FIG. 3*a*. Hydraulic pressure in region 72 must be sufficient and reach a high enough pressure (ie higher than normal fracking pressure) to move sleeve 71 and associated piston 80 downhole against biasing force created by biasing mechanism/spring 90 on spring mandrel 100 a sufficient distance to cause sleeve 72 to uncover port 75, whereby pressurized fluid may then flow to the actuation means 165 and force-magnifying assemblies 170, to thereafter actuate the punch mechanism 175. Biasing mechanism 90 located at the opposing end of the first piston 80 further ensures that the first piston 80 moves uphole within the first cylinder 95 to return the valve 70 to a closed position when fluid pressure is reduced.

Figure 3A:
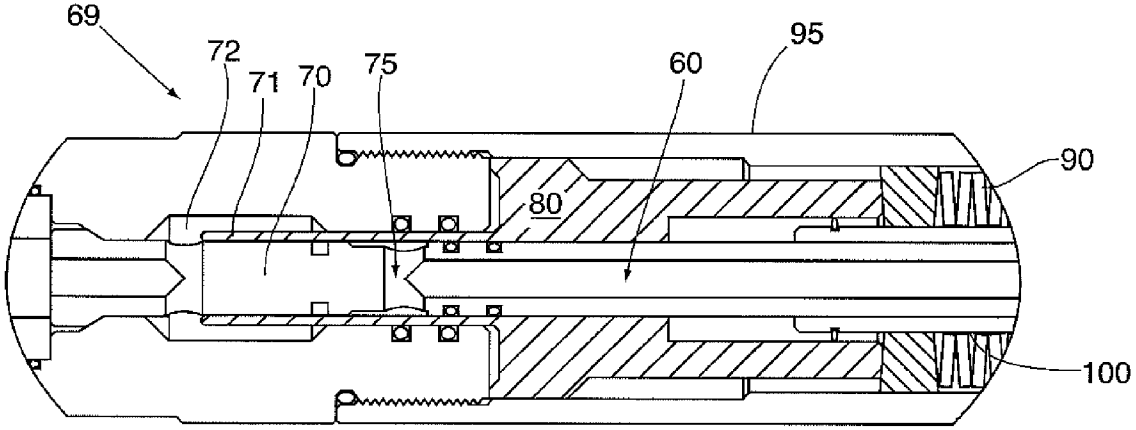
FIG. 3*a* is an enlarged view of the activation assembly (region "C") of the combined perforating and fracking tool shown in FIG. 1*b;*
Figure 3B:
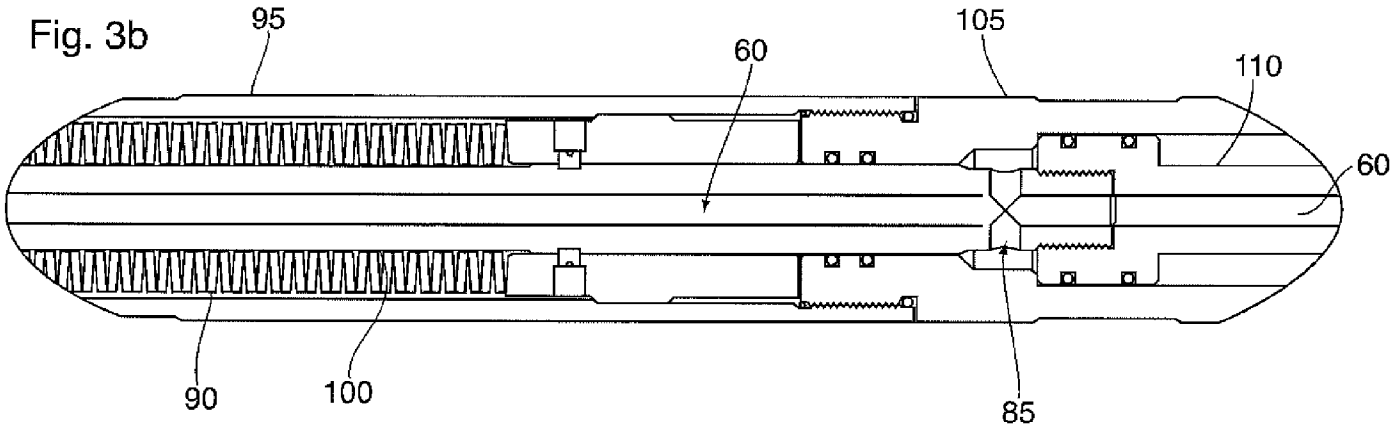
FIG. 3*b* is an enlarged view of the lower end of the activation assembly (region "D") shown in FIG. 1*b;*
Figure 4A:
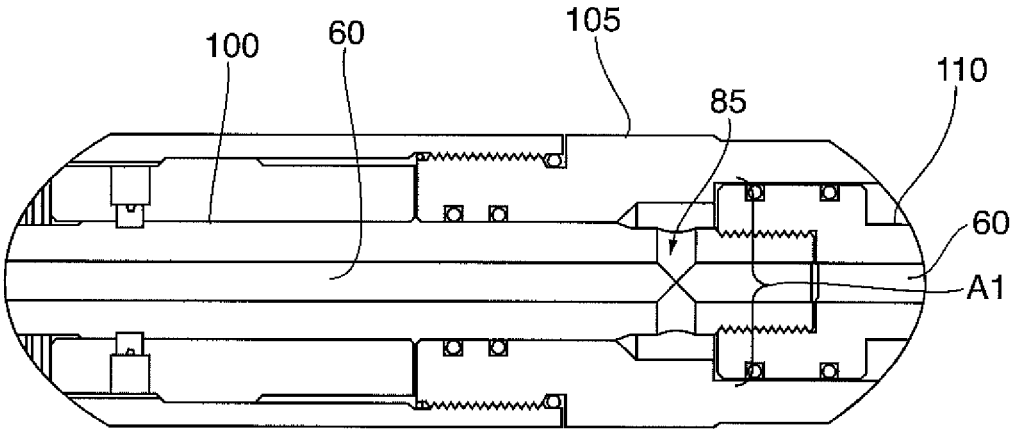
FIG. 4*a* is an enlarged view of the upper end (region "E") of the magnifying assembly of the combined perforating and fracking tool shown in FIG. 1*a;*

The biasing mechanism 90 in the preferred embodiment comprises a plurality of circular washers 90 supported by a spring mandrel 100 (FIG. 3*b*). The spring mandrel 100 comprises a bore 60 through which fluid entering the tool 10 at the uphole end 5 flows when the floating valve 70 is actuated to an open position. The spring mandrel 100 fluidly connects the first cylinder 95 to the adjacent second cylinder 105 containing the magnifying assembly 170. Specifically, as shown in FIGS. 3*b* and 4*a*, the spring mandrel 100 is in fluid connection with a second (additive) piston 110 of cross-sectional area A1 disposed within the adjacent second cylinder 105. When in the open position, fluid is allowed to flow through the spring mandrel 100 and out through the associated ports 85 to fill the second cylinder 105. Fluid pressure P within the second cylinder 105 increases to as to cause second (magnifying) piston 110 of cross-sectional area A1 to move downhole therein.

Figure 4B:
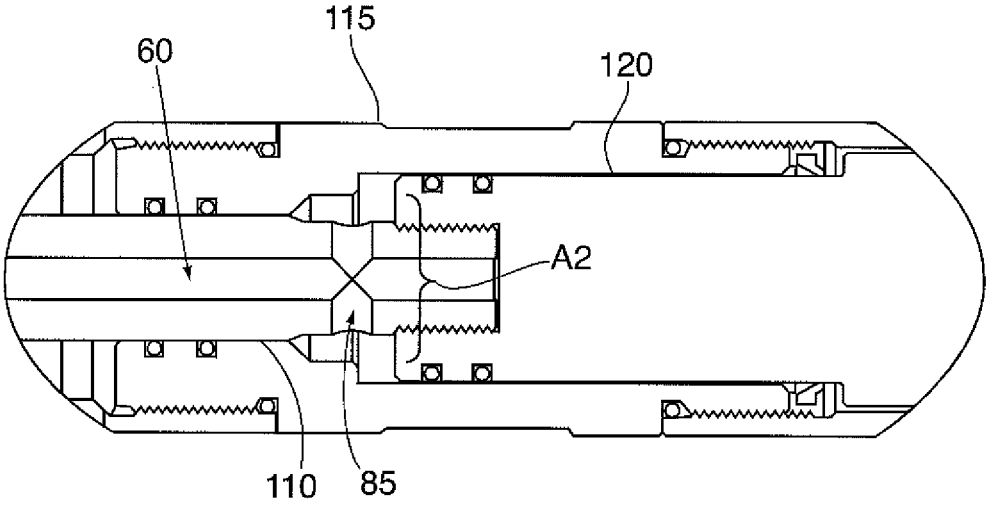
FIG. 4*b* is an enlarged view of the lower end (region "F") of the magnifying assembly shown in FIG. 4*a;*
Figure 5A:
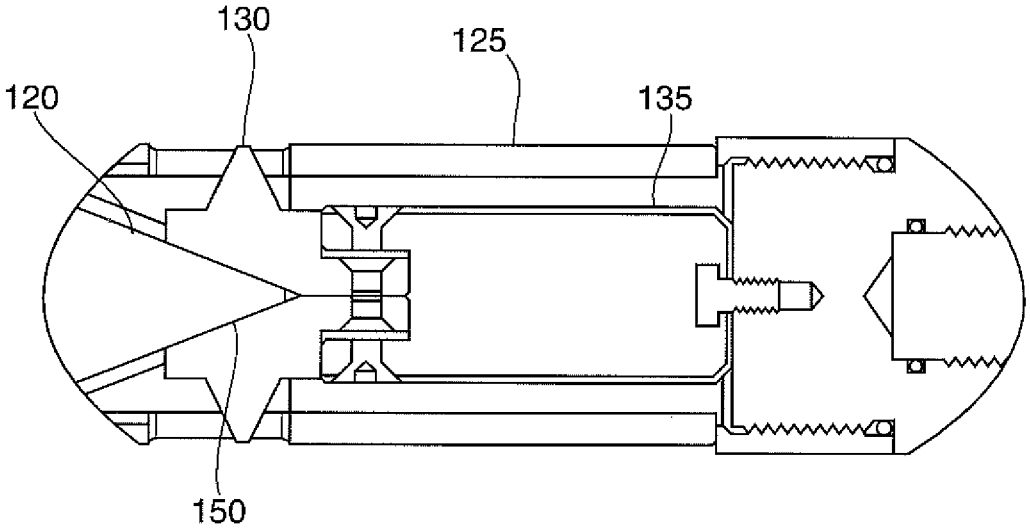
FIG. 5*a* is an enlarged view of one embodiment of the punching assembly (region "G") of the combined perforating and fracking tool shown in FIG. 1*a;*
Figure 5B:
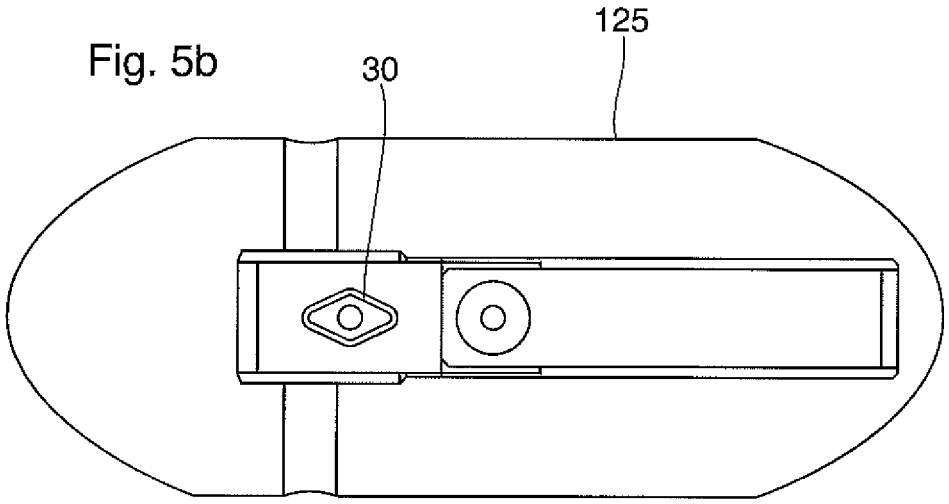
FIG. 5*b* is an enlarged exterior view of the punch assembly shown in FIG. 5*a*, according to one embodiment of the disclosure.
Figure 6:
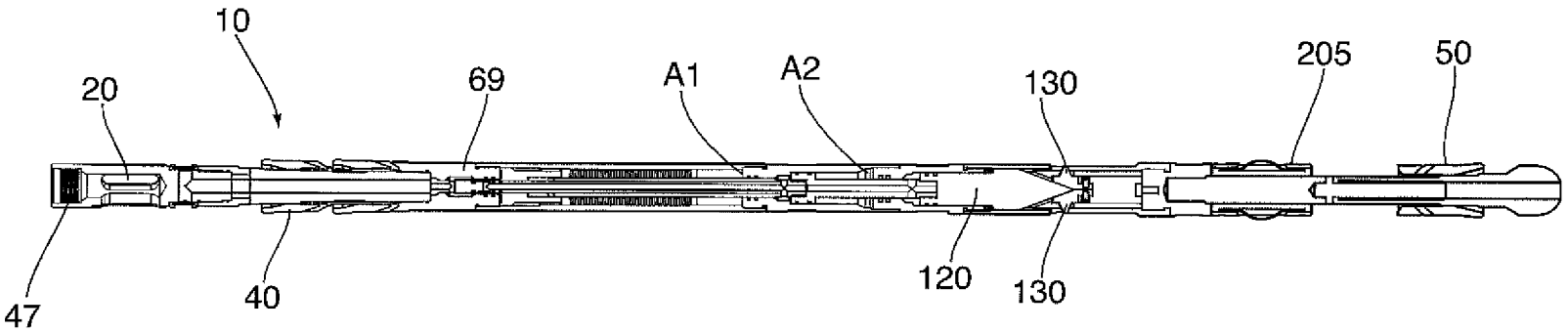
FIG. 6 is a longitudinal cross-sectional view of the combined perforating and fracking tool shown in FIG. 1*a*, showing areas A1, A2 of the pistons so as to illustrate the magnification of force in the combined perforating and fracking tool according to a preferred embodiment of the present invention.

As shown in FIG. 4*b*, the second piston 110 of cross sectional area A2 fluidly connects the second cylinder 105 to the adjacent third cylinder 115 containing the punch assembly/mechanism 175 comprising punch piston 120 having pointed member 150 thereon. Specifically, as shown in FIG. 4*b*, the second piston 110 is in contact, and in fluid communication with, a third (punch) piston 120 disposed within the adjacent third cylinder 115. Fluid flowing through the fluidly connected second piston 110 enters the third cylinder 115 through the associated ports 85 to fill the third cylinder 115 whereby fluid pressure within the third cylinder 115 increases to cause the third (punch) piston 120 to move downhole therein. The third (punch) piston 120 is a closed member such that fluid can only be directed through ports 85 to fill, and correspondingly increase the fluid pressure of the third cylinder 115. In this way, the hydraulic force that is generated by the series of pistons on punch piston 120 is increased. The hydraulic force applied to second piston 110 of cross-sectional area A1 may be described in reference to FIG. 4*a* and FIG. 6 by the following equation:

$$\text{Total Hydraulic force}=P*A1$$

where A1 refers to the area of the piston 110 within the magnifying assembly 170, and P refers to the pressure supplied to such piston 110 of area A1.

Additional pistons add to the force ultimately be applied to actuate the punch assembly. For example, additional third piston 120 will have not only the force exerted by the pressure on A2 (see FIG. 4*b*), but will further have the force exerted by the pressure on area A1 of second piston 110. In this way, the working force of the tool 10 to operate punch mechanism 175 can be increased by utilizing successive hydraulic addition to increase the hydraulic force generated to actuate the punch assembly. Clearly, additional successive series of hydraulic cylinders and pistons may further be used, in tandem, if further addition of the acting force is necessary to achieve perforation of the casing.

Specifically, it is contemplated that in certain embodiments additional magnifying piston assemblies may be added to the tool by inserting additional cylinders comprising such assemblies. In this way, the total force may be further increased which is applied to the perforating members. Where an additional (third) piston 120 of cross-sectional area A2 is added, in such instance the total hydraulic magnification of force F will increase as follows:

$$F=P*A1+P*A2$$

Using such above principle further successive pistons and cylinders may be added to further increase the force which is acting on pointed member end 130, if required.

Other means of increasing the force exerted by the pointed member end 150 of third piston 120 to cause extension of pointed members 130 and thereby perforation of the well casing will now occur to those of skill in the art of hydraulics.

For example, hydraulic arrangements where successive pairs of coupled pistons 1-2 and 3-4, each piston of each pair being of alternating larger and smaller respective associated cross-sectional areas A1, A2, A3, A4, where for example A1>A2, A3>A2, and A3>A4, could alternatively be used to obtain further successive increases of hydraulic pressures, where P1<P2<P3, and where P2=P1×A1/A2 and P3=P2×A3/A4. Resulting magnified pressure P3 which results from such arrangement of coupled pistons and respective cross-sectional areas produces the following magnified total force on last piston of area A5 (ie on last member 120):

$$F=P3\times A5$$

or stated otherwise:

$$F=[P1\times A1/A2\times A3/A4]\times A5$$

Referring to FIG. 5*a*, 5*b*, FIG. 12, FIG. 13, and FIGS. 14, & 14*a*-14*d*, the closed last piston, in this embodiment third (punch) piston 120, has a pointed downhole member 150. Such pointed downhole member 150 has a slanted pointed extremity which has a slope which corresponds to the slope of inclined surface 240 possessed by each punch member 130. When the punch mechanism 175 is actuated by the float valve 70 allowing incoming fluid under pressure to displace pistons 100 (of area A1) and piston 120 of area A2 downhole, the pair of pointed perforating members 130 are forced apart by the pointed end 150 of the third (punch) piston 120 so as to outwardly extend from the tool 10 and thereby pierce the well casing at the desired location.

In preferred embodiments, the pair of pointed perforating members 130 are connected by a biasing assembly, which in one embodiment comprises a coupling member 135 and base member 140 to inwardly retract the pair of perforating punch members 130 once the casing has been perforated, the hydraulic pressure reduced, and the punch members 130 thereafter desired to be retracted to allow the tool to be repositioned to allow perforation of the casing at another desired location.

Alternatively, instead of using a coupling member 135 and a base member 140 to bias the perforating member 130 within the tool 10 as best shown in FIG. 14 and FIGS. 14*a*-14*d*, other biasing means could be used and will now readily occur to persons of skill in the art.

For example, a pair of resiliently-biased helical springs (not shown) could alternatively be used to bias the perforating members 130 inwardly when not in the actuated position, to thereby allow displacement of the tool 10 uphole or downhole to a new fracking or perforating location after the perforations have been created in the casing.

Hydraulic Fracturing of the Formation

When the perforation operation has been completed at one location along the wellbore, in one embodiment of the method of the present invention the tool 10 is simply lowered further downhole in the well. Slidable member 205 (see FIG. 28) due to frictional engagement with the well casing, is then caused to slide uphole thereby exposing fluid egress port 251 (see FIG. 28) which thereby allows fluid which is being displaced by the downward movement of the tool 10 to bypass downhole cup seal 50 and thereby allow continued movement of tool 10 downhole. Fracking injection ports 20 on tool 10 can then be positioned directly opposite previously-created perforations in the casing, in order to carry out the fracking operation and inject fluid into the formation by causing such fluid to be injected downhole and egress through fracking injection ports 20 and thereafter into the formation through the created perforations in the casing. In this way, the tool 10 achieves both perforating and fracking operations in the well without removal of the tool 10 between operations. Accordingly, both perforating and fracking operations can be conducted while maintaining the tool in situ.

Figure 25:
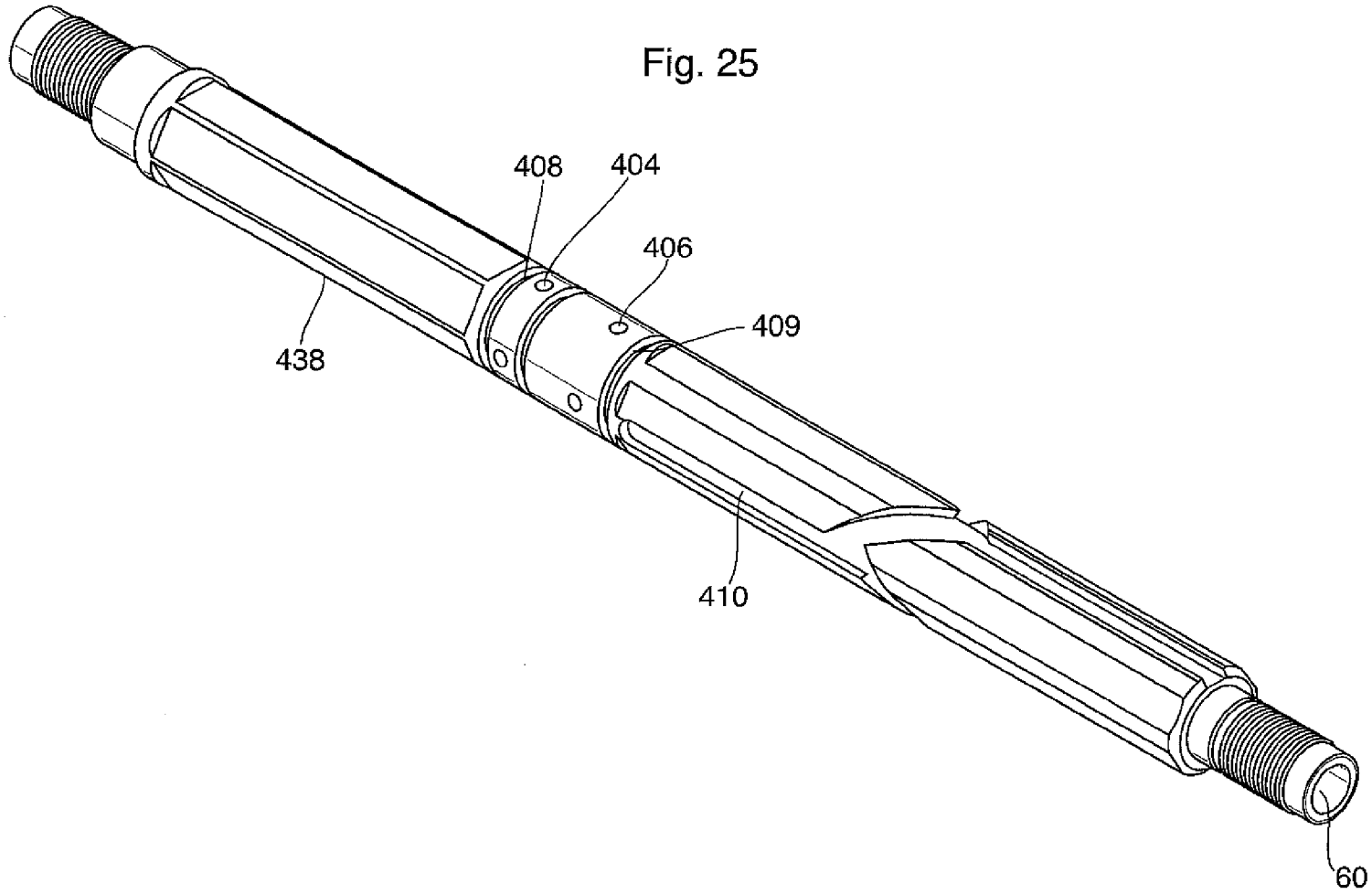
FIG. 25 is a perspective view of the "J" type mandrel which forms part of the valve means for actuating the punch assembly.

Referring to FIGS. 1*a* and 1*b* and FIG. 25, the tool 10 comprises a fracking assembly 160 comprising an upper fracking mandrel 47 connected to the first cylinder 95 containing the activation assembly 165. An upper mandrel 35, to which the fracking mandrel 47 is coupled, is in turn coupled to the valve assembly 69 (see FIGS. 3*a*, 9*a*, and 17*a*) in the first cylinder 95. Fluid pumped downhole via a tubing string (not shown) to which fracking mandrel 47 (and thus tool 10) is coupled flows out fracking ports 20. Thereafter such fluid re-enters the tool 10 via injection ports 55 [(which are covered with a protective screen 25 (see FIG. 2*a*, 2*b*, and FIG. 25) to reduce cuttings and the like entering the tool 10] and thereafter flows to the valve assembly 69. As discussed, the valve assembly 69, in its various further embodiments described below, operates to control activation of the perforating function of the tool 10. The perforating function of the tool 10 is activated when fluid is injected into the tool 10 at a sufficient hydraulic pressure (ie higher than normal fracking pressure). In one embodiment, the perforating function of the tool 10 is activated, and requires a hydraulic pressure of at least 6,000 psi. in order that valve assembly 69 pass fluid to the force-magnifying assembly 170. As shown in FIG. 1*b*, fluid injected at pressures less than that required to activate the valve assembly 69 does not flow past the valve assembly 69 and into the force-magnifying assembly 170, since due to the closed valve assembly 69 it is unable to flow into injection ports 55 in the fracking mandrel 47 at the uphole end 5 of the tool 10. When the fracking fluid injection ports 20 are positioned adjacent the perforations that were made in the casing, the diverted fluids are injected into the formation to achieve fracking as discussed.

The fracking assembly 160 located at the uphole end 5 of the tool 10, is spaced apart from the punch assembly and punch port 30 located at the downhole end 15 of the tool 10, at a fixed and known distance. Accordingly, when the perforation operation has been completed, the tool 10 can simply be lowered into the well by the fixed distance to position the fracking assembly, and more specifically the fracking fluid injection ports 20, at the perforations made in the casing. In this way, the perforated sections of the casing can be located easily without the need for additional equipment such as cameras or sensors, ensuring accuracy and repeatability of the operation. The length of the tool 10, according to certain embodiments, can be adjusted to the desired operation. In one embodiment, the tool has a length of between about 2,500 to about 3,000 mm. In a further embodiment, the tool has a length of between about 2,600 to about 2,900 mm. In another embodiment, the tool has a length of between about 2,700 to about 2,800 mm.

In preferred embodiments, the tool 10 comprises at least one sealing member 40 disposed proximate an upper region of the tool 10, and a further sealing member 50 at an opposite downhole end of the tool 10 (FIGS. 1*a* and 1*b*, and FIGS. 26-28). A variety of known sealing members may be utilized, however, according to preferred embodiments the sealing members are frustoconically shaped cup seals. Each sealing member 40, 50 is respectively mounted on the tool 10 so that their respective flared ends are oppositely opposed. Specifically, the sealing members 40, 50 are biased into sealing contact with the casing when pressurized fluid flows against the sealing members 40, 50 between the tool and well casing. When facturing fluid is injected into the well through the fracking fluid injection ports 20, the sealing members 40 expand into sealing contact with the casing walls to prevent flow of fracturing fluid downhole via space between the tool and the casing.

As shown, one sealing member 40 is located at the uphole end 5 of the tool 10, downhole of the fluid injection port 20, with the flared end oriented uphole (ref. FIG. 1*a*, and FIG. 26*a*, 26*b*). In this way, it is ensured that pressurized fluid that is diverted through the fluid injection ports 20 of the tool 10 is directed through the perforations in the well casing to enter the formation and induce fracturing. A second sealing member 50 is located at the downhole end 15 of the tool 10, downhole of the punch port 30. The second sealing member 50 is oriented with its flared end directed downhole such that downhole fluids are prevented from flowing upwardly between the casing and the tool 10. In this way, the sealing members 40, 50 together prevent fluids, and sand entrapped therein, from entering the space between the casing and the tool 10, thereby avoiding "sanding in" of the tool 10 in the well.

In certain embodiments, an additional third sealing member 45 (ref. FIG. 1*b*, and FIG. 26*a*) may be connected to the tool 10 downhole of the first sealing member 40 located at the uphole end 5 of the tool 10, to provide additional back-up should the first sealing member 40 fail under the injected fluid pressure used during fracking and/or perforating.

In one embodiment of the method of using a combined fracking and perforating tool 10 of the present invention, the process of fracking and perforating may commence from the top of the wellbore, and the tool 10 is lowered downhole an incremental desired distance, the punch members, namely the pointed perforating members 130 actuated to perforate the casing, and then tool 10 is lowered further downhole a known distance, namely the distance on the tool 10 between the perforating members and the frack fluid injection port 20, so as to position the frack port 20 over the created perforation in the well casing. Such process is successively repeated until the tool perforates and fracks along the entire length of the wellbore until the tool reaches the bottom of the wellbore, wherein the tool is then withdrawn from the well.

In the above method when the tool 10 reaches the bottom of the wellbore the perforations and fracks in the wellbore are all above the tool 10 with direct access to the formation. Ingress of fluid into the wellbore above the tool 10 may contain sand, and with the result with the possible ingress of sand tool 10 could become "sanded in", and thus be not able to be removed from the well.

Accordingly, in an alternative embodiment of the method of using the combined fracking and perforating tool 10 of the present invention, the process of fracking and perforating may instead commence close to the bottom of the wellbore. In such method, the tool 10 is first lowered to the bottom of the wellbore, a slight distance from the bottom of the wellbore. The perforating members 130 are actuated to perforate the casing in such location. Thereafter, tool 10 is lowered further downhole a short known distance, namely the distance on the tool 10 between the perforating members 130 and the frack port 20, so as to position the frack port 20 over the created perforation in the well casing, and frack fluid supplied to frack port 20 to frack the formation at such location along the wellbore via the created perforations. Thereafter, the tool 10 is raised uphole to a desired further location for perforating and fracking, and the perforating members 130 again actuated to perforate in such location. Tool 10 again lowered the same short known distance to position the frack ports 20 over the newly-created additional perforations in the well casing, and frack fluid supplied to frack port 20 to frack the formation at such new location. The tool 10 is then further moved uphole an incremental distance, and the process repeated until the entirety of wellbore has been perforated and fracked, at which point the tool 10, now proximate the top of the wellbore, is then removed from the wellbore. In such manner, all communication between the wellbore and the formation is then below the tool 10, with the result that any potential "sanding in" problems may be avoided.

As discussed above, FIG. 3*a* shows a valve assembly 69 which is used to allow supply of fluid within bore 60 for actuating pistons 110 and 120, to cause radial extension of pointed punch members 130 to perforate the casing. Such valve assembly 69, as discussed above, comprises a valve stem 70 over which, when the valve 69 is in a closed position, a sliding sleeve 71 sits. Upon application of hydraulic pressure greater than fracking pressure and sufficient to overcome spring force exerted by springs 90 on mandrel 100 which bias piston 80 in a closed position, causes the sliding sleeve 71 (part of piston 80) to be displaced and moved from covering port 75, thereby allowing flow of fluid into port 75 and thus allowing flow of such hydraulic fluid into bore 60 and thence to pistons 110 and 120.

Notably, however, other types of valve assemblies 69 for selectively, when desired, allowing pressurized fluid into bore 60 to actuate downhole pistons such as 110, and 120 to actuate punch mechanism 175, are possible.

Below described are three (3) further types of valve assemblies 69.

Figures 7, 8, 9A, 9B:
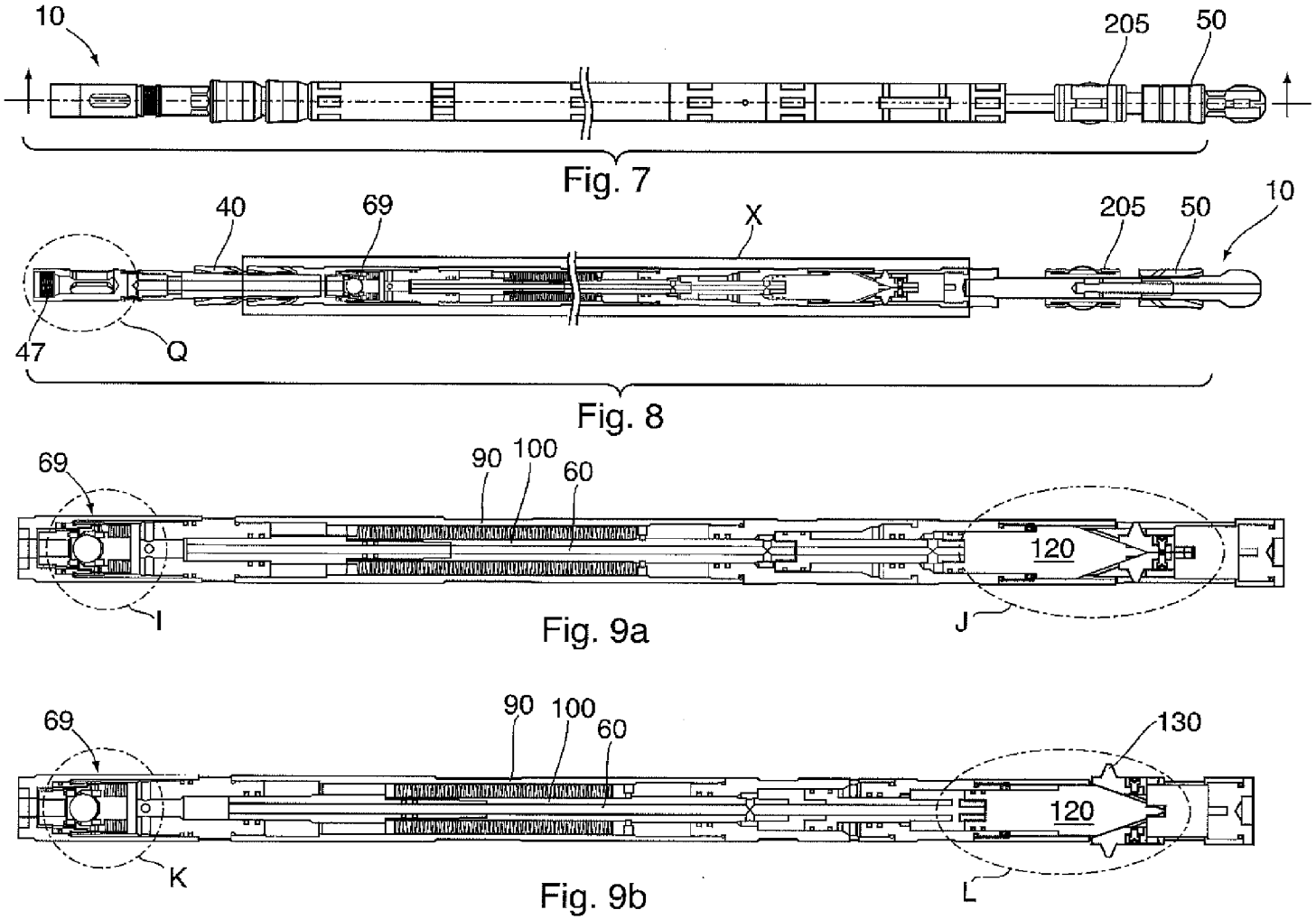
FIG. 7 is a view on a further embodiment of the tool of the present invention, utilizing a single ball as a seal.
FIG. 8 is a longitudinal cross-sectional view along the plane defined by the arrows in FIG. 7, when the punch assembly is in the non-actuated position.
FIG. 9*a* is an enlarged view of region "X" of FIG. 8 when the punch assembly of the tool is not actuated.
FIG. 9*b* is a similar enlarged view of region "X" of FIG. 8, when the punch assembly of the tool is actuated.
Figure 10:
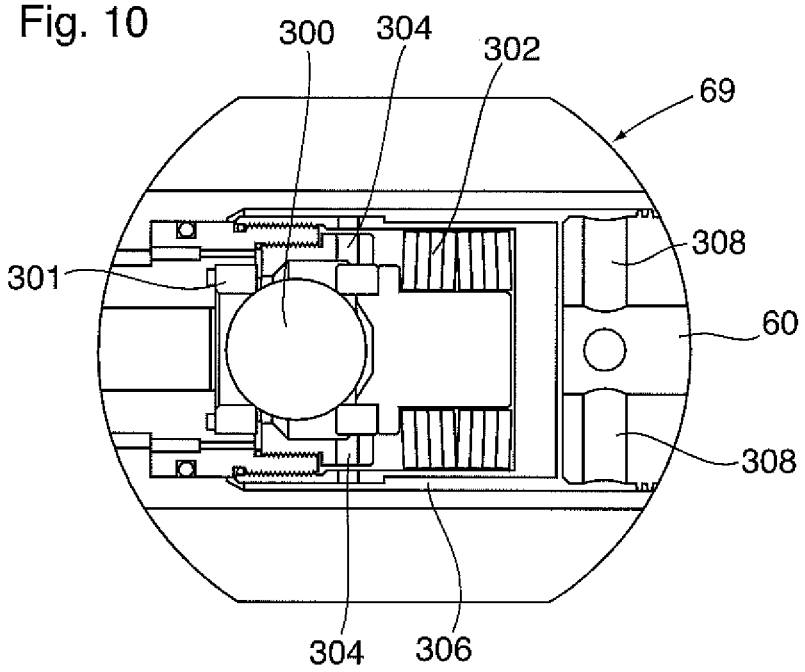
FIG. 10 is an enlarged view of region "I" of FIG. 9*a*, namely when the tool and the punch assembly is non-actuated.
Figure 11:
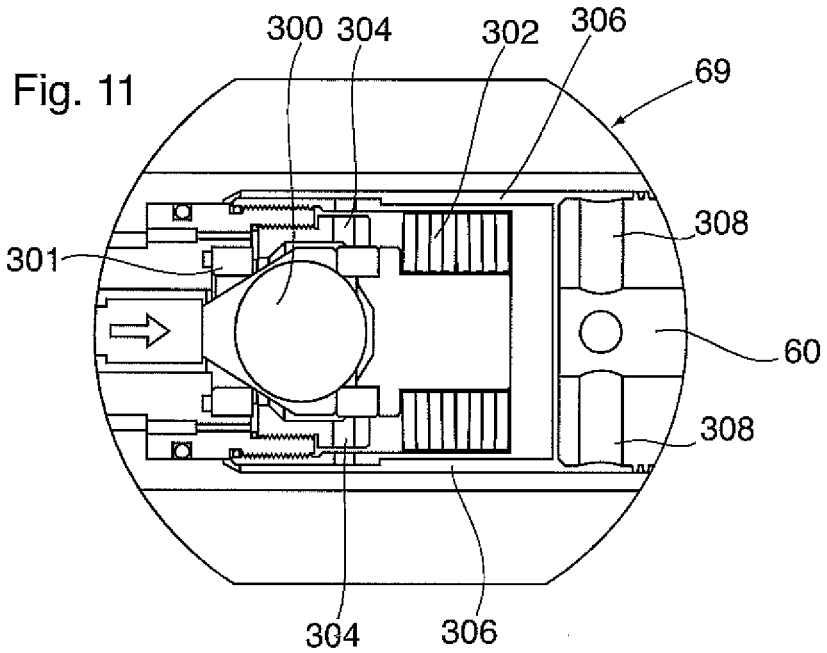
FIG. 11 is an enlarged view of region "K" of FIG. 9*b*, namely when the tool and the punch assembly is actuated.
Figure 12:
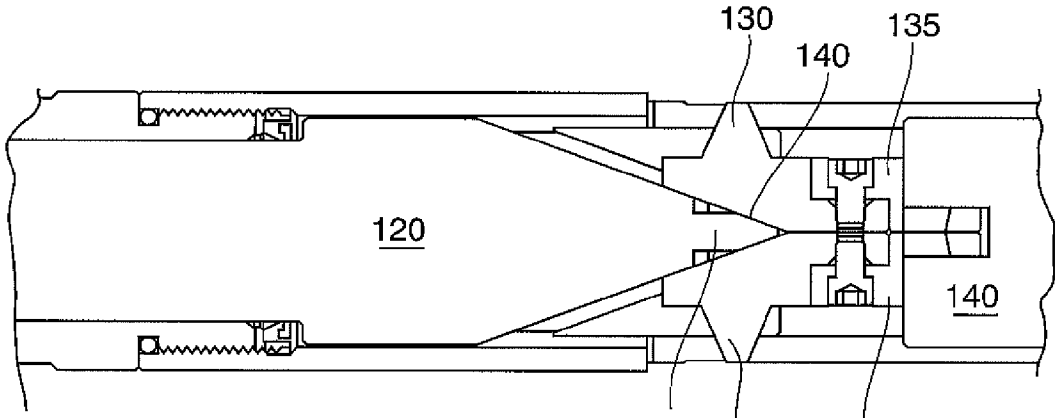
FIG. 12 is an enlarged view of region "J" of FIGS. 9*a*, 17*a*, & 23*a* (and similarly of region "G") of FIG. 1B), when the tool and the punch assembly thereof is non-actuated.
Figure 13:
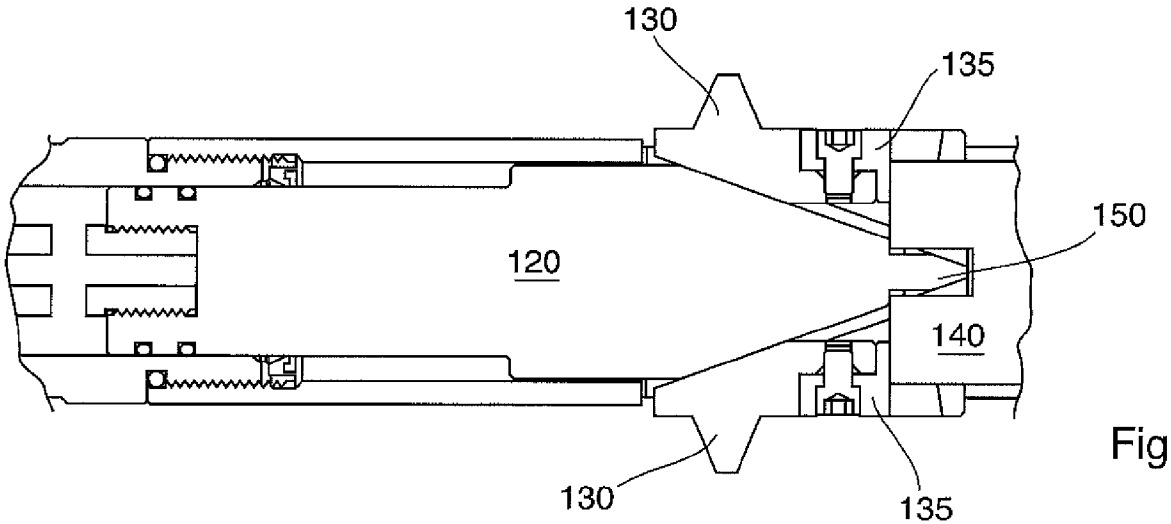
FIG. 13 is an enlarged view of region "L" of FIGS. 9*b*, 17*b*, & 23*b*, namely when the tool and the punch assembly thereof is actuated.
Figures 14, 14A, 14B, 14C, 14D:
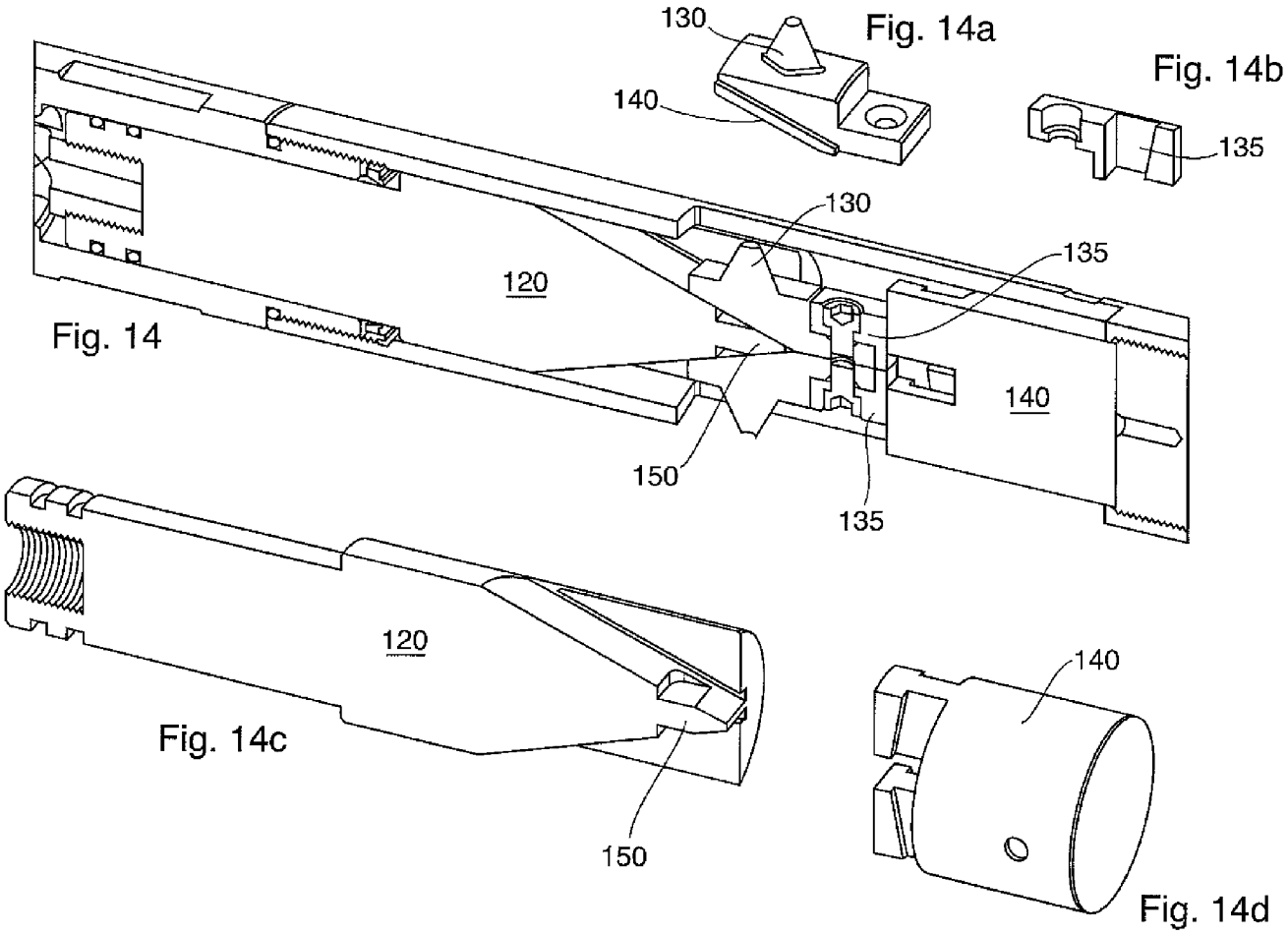
FIG. 14 is an enlarged perspective view of a cross section through one embodiment of the punch assembly of the present invention shown in FIGS. 12 & 13.
FIG. 14*a* is an enlarged perspective view of one component of the punch assembly shown in FIGS. 12 & 13, namely one of the pointed members thereof.
FIG. 14*b* is an enlarged perspective sectional view of another component of the punch assembly shown in FIGS. 12 & 13, namely one of members for retaining an associated pointed member in a desired position.
FIG. 14*c* is an enlarged perspective sectional view of another component of the punch assembly shown in FIGS. 12 & 13, namely one of members for retaining an associated pointed member in a desired position.
FIG. 14*d* is an exploded perspective view of the base member of FIG. 14.

Specifically, one such other embodiment of valve assembly 69 which may be incorporated in the tool 10 of the present invention is best shown in FIG. 9*a* and FIG. 10 (un-actuated) and in FIG. 9*a* and FIG. 11 (actuated). As may be seen, the valve assembly 69 may instead comprise a single ball 300 biased against ball seat 301 by means of washer springs 302. Upon supply of fluid in the direction of the "arrow" shown in FIG. 11 of a pressure sufficient to overcome the biasing force of washer springs 302, thereby displacing ball 300 from ball seat 301, and pressurized fluid is then allowed to flow through ports 304 into radial passageway 306 into radial ports 308, and thereafter into bore 60 for thereafter actuating pistons 110, 120.

Figures 15, 16, 17A, 17B:
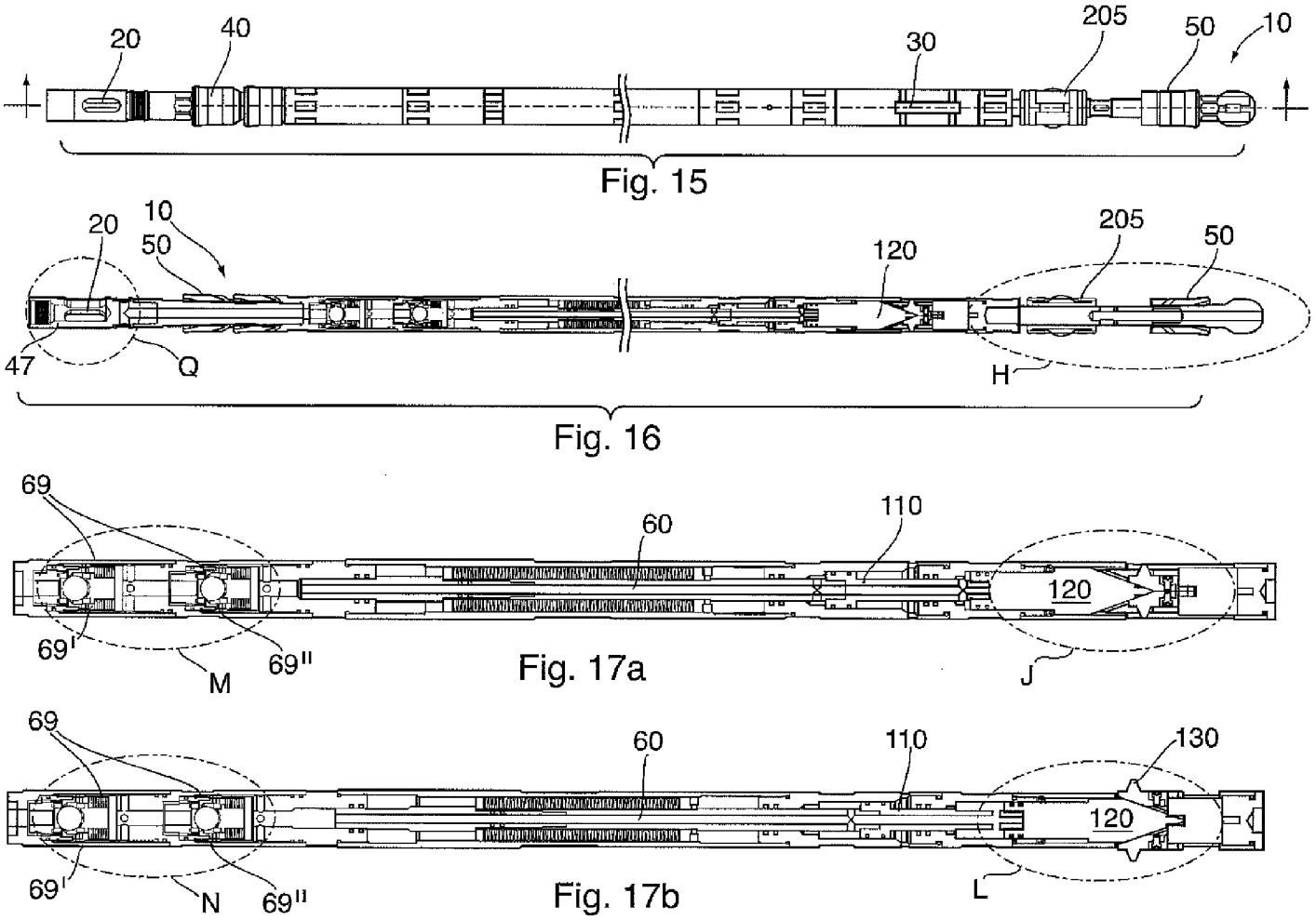
FIG. 15 is a side exterior view of a second embodiment of the combined perforating and fracking tool of the present invention.
FIG. 16 is a longitudinal cross-sectional view of another embodiment of the combined perforating and fracking tool of the present invention which uses a "two ball" valve, taken along the plane of the arrows shown in FIG. 15.
FIG. 17*a* is an enlarged cross sectional view of a portion of the combined perforating and fracking tool shown in FIG. 16, when such tool, and the punch members thereof are in the non-actuated state.
FIG. 17*b* is an enlarged cross sectional view of a portion of the combined perforating and fracking tool shown in FIG. 16, when such tool and the punch members thereof are in the actuated state.
Figure 18:
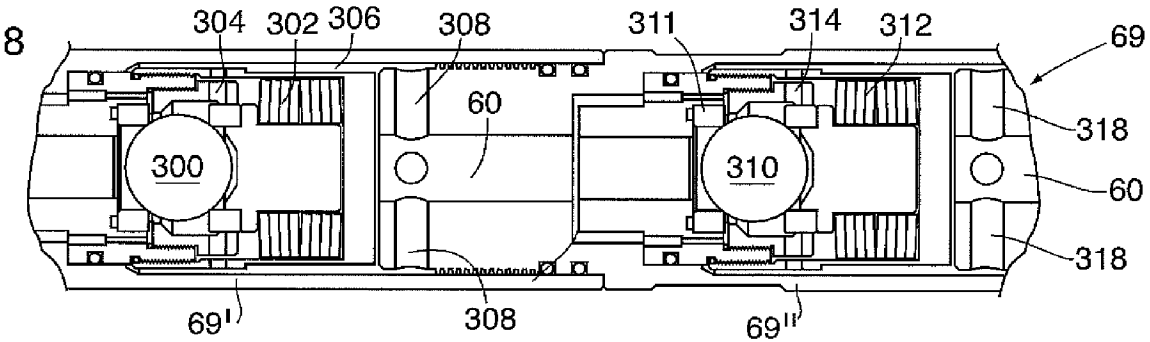
FIG. 18 is an enlarged view of region "M" of FIG. 17*a;*
Figure 19:
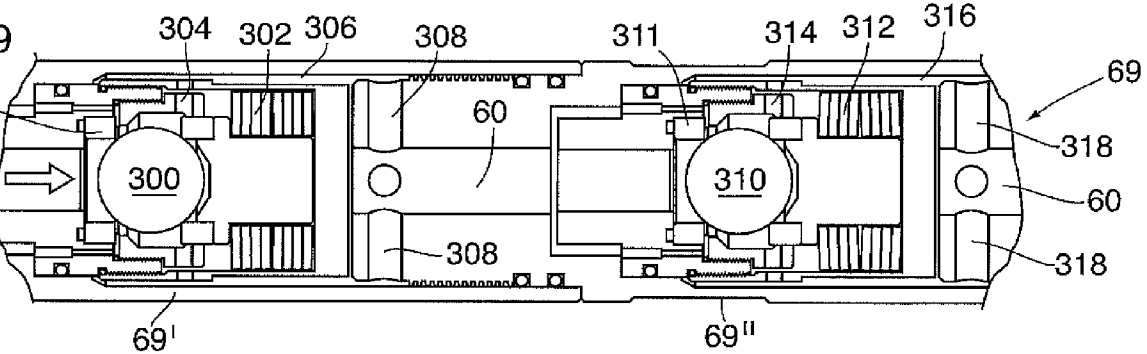
FIG. 19 is an enlarged view of region "M" of FIG. 17*a*, when the tool, and in particular the valve in region "M", is in the partially actuated state.
Figure 20:
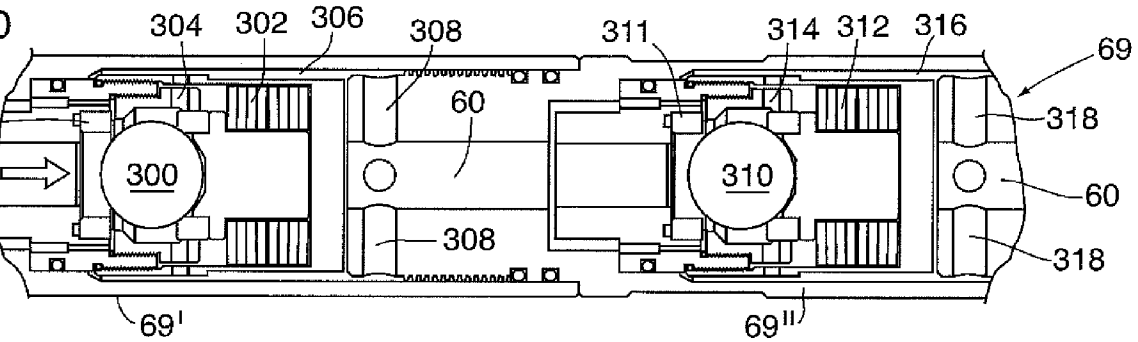
FIG. 20 is an enlarged view of region "N" of FIG. 17*a*, when the tool is in the fully actuated state and the punch members are actuated.

Another embodiment of valve assembly 69 which may be incorporated in the tool 10 of the present invention is best shown in FIG. 17*a* and FIG. 18 (un-actuated position), partially actuated position (FIG. 19), and in fully acutated position (FIG. 17*b* and FIG. 20. As may be seen, therefreom, the valve assembly 69 instead comprise a pair of ball valves 69' and 69", each having a respective single ball 300, 310 biased against respective ball seats 301, 311 by means of respective washer springs 302, 312.

Second ball valve 69" in effect acts as a redundancy, to ensure any leakage from ball valve 69' does not inadvertently actuate punch assembly 175.

Upon supply of fluid in the direction of the "arrow" shown in FIG. 18 (of a pressure sufficient to overcome the biasing force of washer springs 302) pressurized fluid is then allowed to flow through ports 304 into radial passageway 306 and thence into radial ports 308, and thereafter into bore 60. This semi-actuated position is showing in FIG. 19.

Thereafter, continued supply of pressurized fluid to second ball valve 69", as shown in FIG. 20 serves to fully actuate this valve assembly 69 by then further overcoming the biasing force of washer springs 312, thereby displacing ball 310 from ball seat 311. Pressurized fluid is then allowed to flow through ports 314 into radial passageway 316 into radial ports 318, and thereafter into bore 60 for thereafter actuating pistons 110, 120.

Figures 21, 22, 23A, 23B:
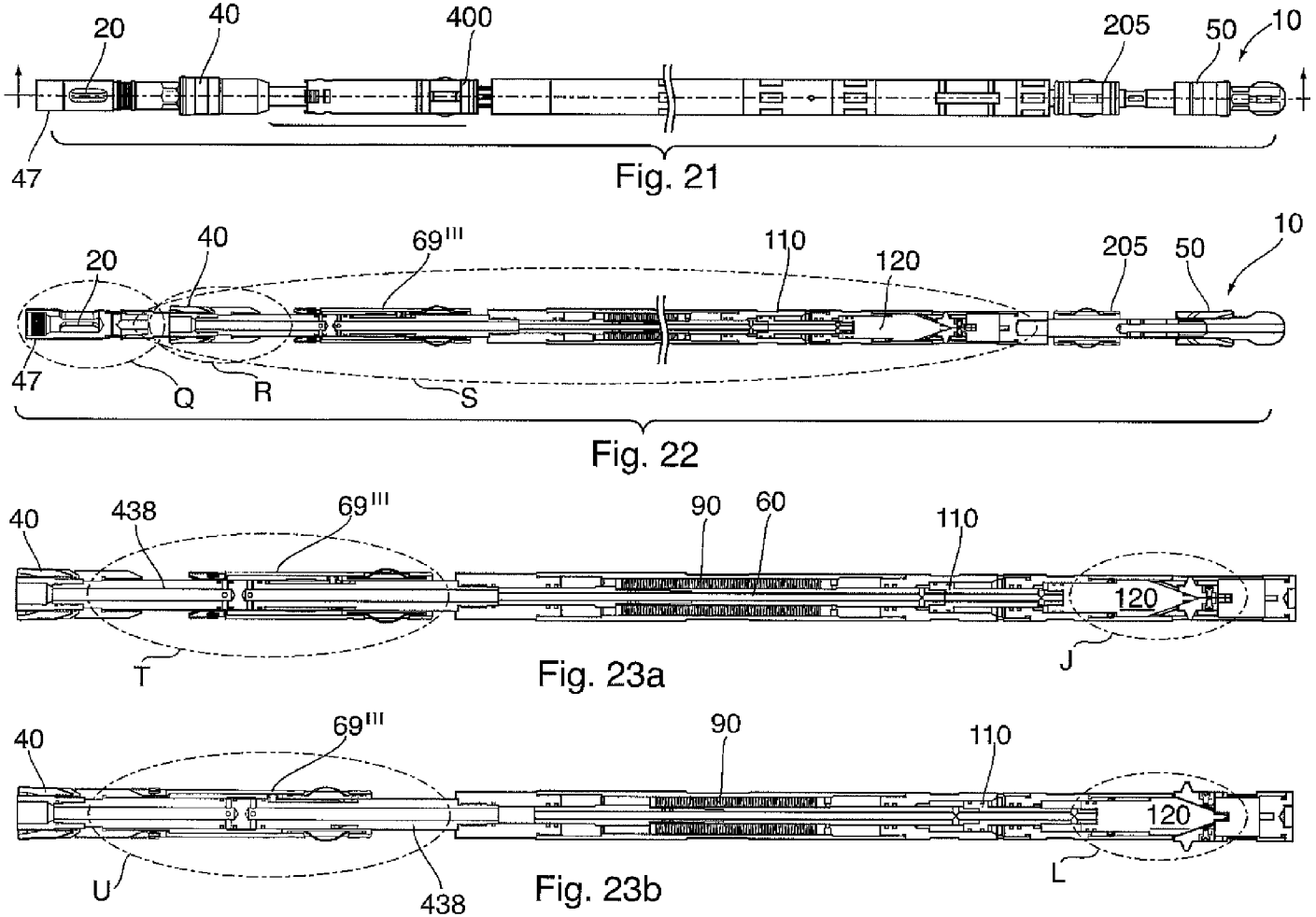
FIG. 21 is a side elevation view on a further embodiment of the tool of the present invention, which uses a "J" slot actuating member.
FIG. 22 is an enlarged cross sectional view of the combined perforating and fracking tool shown in FIG. 21, when such tool, and the punch members thereof are in the non-actuated state, taken in the direction of the arrows in FIG. 21.
FIG. 23*a* is a cross sectional view of a portion "S" of the combined perforating and fracking tool shown in FIG. 22, when such tool and the punch members thereof are in the non-actuated state.
FIG. 23*b* is a cross sectional view of a portion "S" of the combined perforating and fracking tool shown in FIG. 22, when such tool and the punch members thereof are in the actuated state.
Figure 24A:
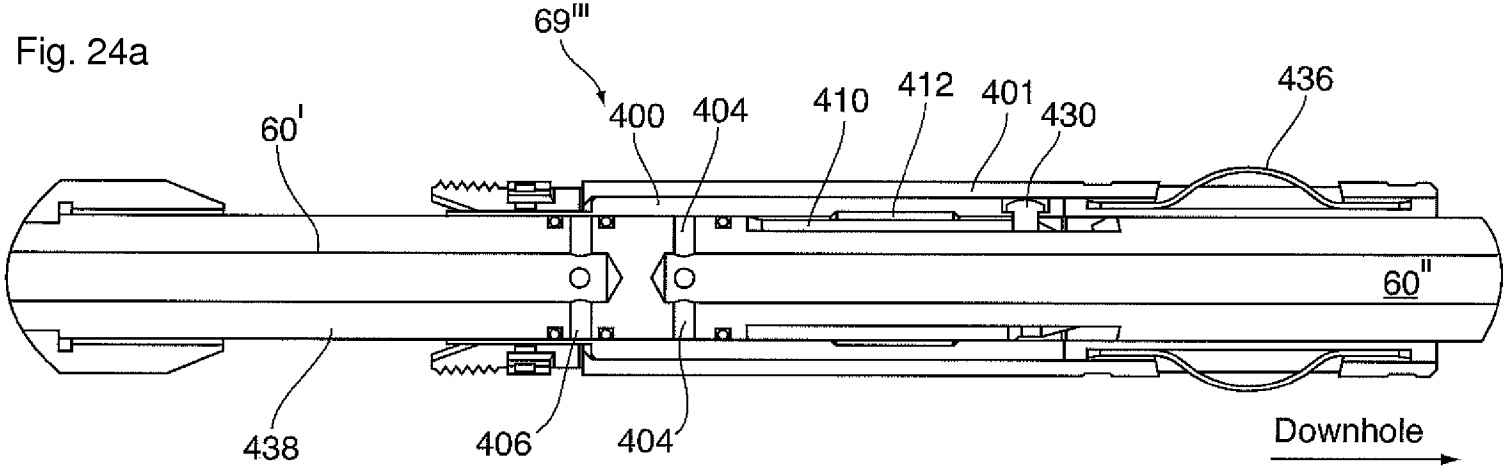
FIG. 24*a* is an enlarged view of region "T" of FIG. 23*a;*
Figure 24B:
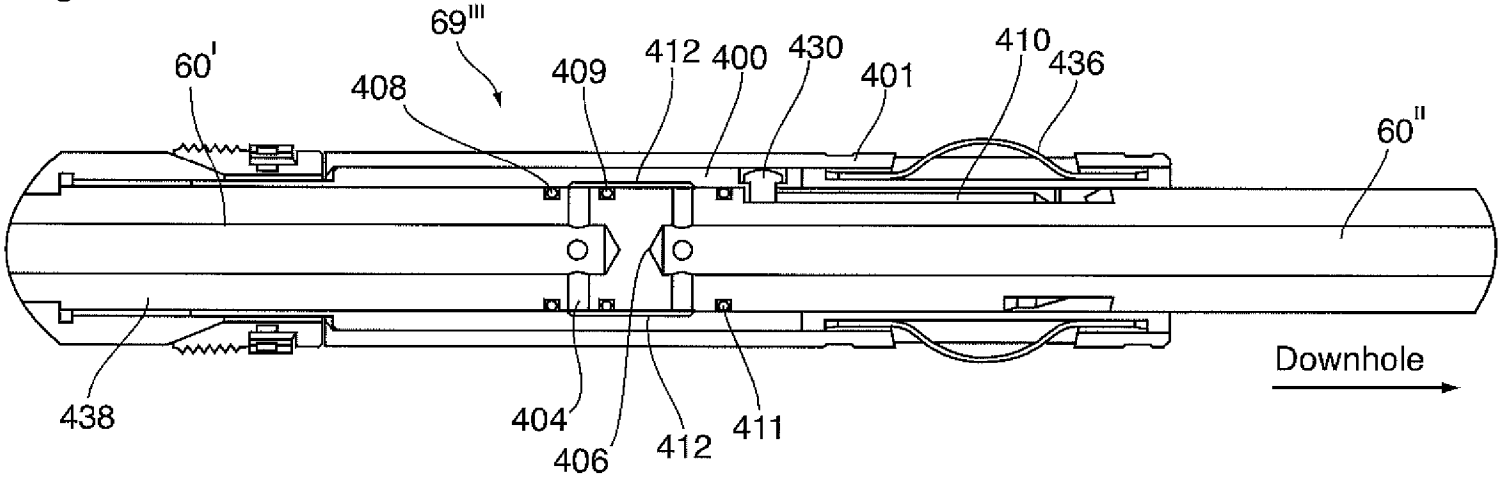
FIG. 24*b* is an enlarged view of region "U of FIG. 23*b;*

A third embodiment 69'" of the valve assembly 69 for the tool 10 of the present invention is shown in FIGS. 21-25, and in particular best shown in FIGS. 23*a*, 24*a* (un-actuated position) and in FIGS. 23*b*, 24*b* (actuated position). In such embodiment a slidable hollow cylinder or "J" sleeve 400 is provided, which is slidable on slotted mandrel 438, such mandrel 438 having hollow longitudinal bores 60', 60" therein over respective portions of the length thereof. Mandrel 438 is provided with a plurality of radial ports 404, 406, which are in fluid communication with bores 60' and 60" respectively. "O" ring seals 408, 409, and 411, are disposed on mandrel 438 on respective lateral sides of each of radial ports 404, 406. Guide pin 430 is situated in longitudinal slot 410 in mandrel 438, and maintained in position by cover sleeve 401. Guide pin 430 serves to permit slidable movement of sliding sleeve 400, and in particular slot 412 therein, over radial ports 404, 406 in mandrel 438.

A plurality of flexible curvilinear spring elements 436 are fixed about an exterior of the valve assembly 69", which spring elements 436 serve, when the tool is inserted in the wellbore, to frictionally engage the interior of the casing of the wellbore. Milled within the interior of sliding sleeve 400 is a slot 412, which like sliding sleeve 400, is thus laterally moveable along exterior surface of mandrel 438 and thence positionable over radial ports 404 and 406 to allow fluid communication therebetween.

In operation, due to frictional engagement of spring elements 436 with exterior of the wellbore casing, upon lowering of the tool 10 downhole within the wellbore, sliding sleeve 400 of valve assembly 69'" will be moved so that slot 412 in sliding sleeve 400 is positioned over radial ports 404, 406, thus allowing fluid communication therebetween, and in particular pressurize fluid coming from uphole to be provided to bore 60. When tool 10 is positioned in the wellbore at a desired location for perforating the casing therein, high pressure fluid may then be supplied to the tool 10 and due to fluid communication permitted between ports 404 and 406 such high pressure fluid is subsequently then supplied to pistons 110, 120 via bore 60" as shown in FIG. 24*b*, to thereby actuate punch assembly 175 and accomplish perforation of the casing at such desired location.

Thereafter, flow of high pressure fluid to the tool 10 is stopped, and the tool 10 further lowered so that the injection ports 20 thereon are positioned a known short distance below the created perforations. Thereafter, tool 10 is raised the known distance to align the injection ports 20 with the created perforations, and in so raising tool 10 within the wellbore frictional engagement of the spring members 436 thereof with the interior of the wellbore casing causes a slidable repositioning of sliding sleeve 400, wherein slot 412 no longer is positioned over radial ports 404, 406 and fluid communication between them is halted, as shown in FIG. 24*a*. In such manner fracking fluid, when then supplied to the tool 10 at such new (uphole) location in the wellbore, will then be diverted to the fracking port 20 and thereafter pass through the created perforations in the wellbore into the formation, to thereby frack the formation at such desired location.

The tool 10 may then be moved uphole to proximate a new (uphole) location for perforating the casing, and then lowered a slight distance to again reposition the sliding sleeve 400 and slot 412 therein over ports 404, 406 to re-establish fluid communication between ports 404 and 406, and the process as above repeated to conduct further perforation and fracking operations until an entire length of formation is fracked, wherein the tool 10 can then be removed from the wellbore.

Figure 26:
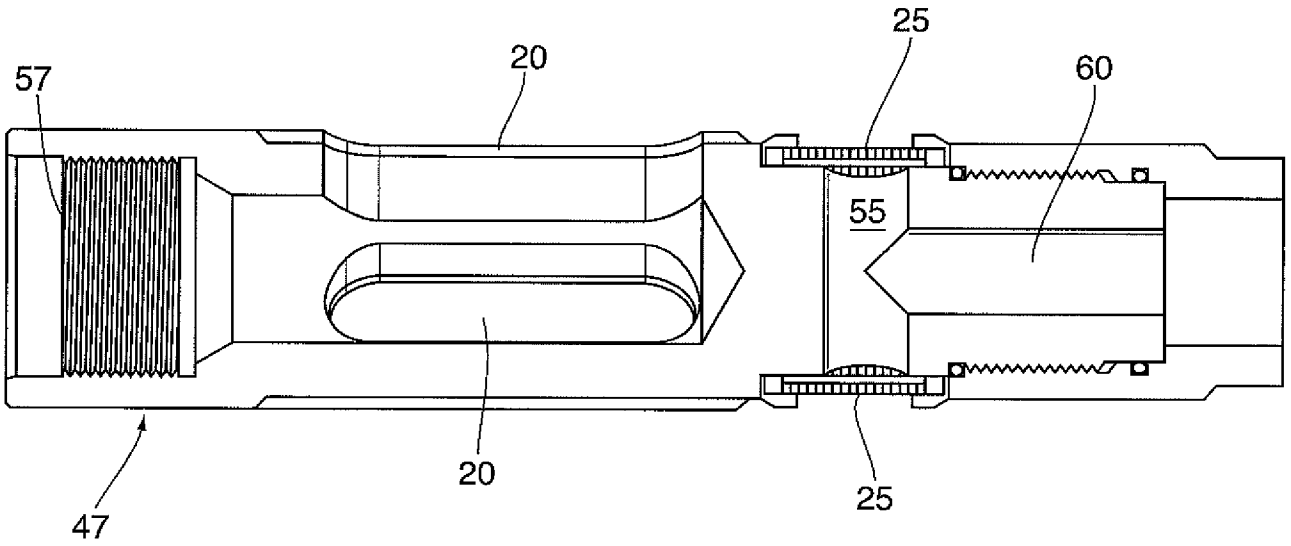
FIG. 26 is an enlarged view of region "Q" of FIGS. 8, 16, & 22

FIG. 26 shows an enlarged view of upper fracking mandrel 47, having injection ports 20 milled therein. The upper end of mandrel 47 preferrably possesses threads 57 to permit threaded coupling of tool 10 to fluid injection tubing. A port 55, protected by a screen 25, is provided therein, which allows fluid received from injection ports 20 and which flows into port 55 via screen 25, to then pass into bore 60 for subsequent supply downhole, and if valve assembly 69, 69', 69", or 69'" is open (opened), to thereafter flow within tool 10 to pistons 110, 120 and thereafter actuate punch members 130.

Figure 27A:
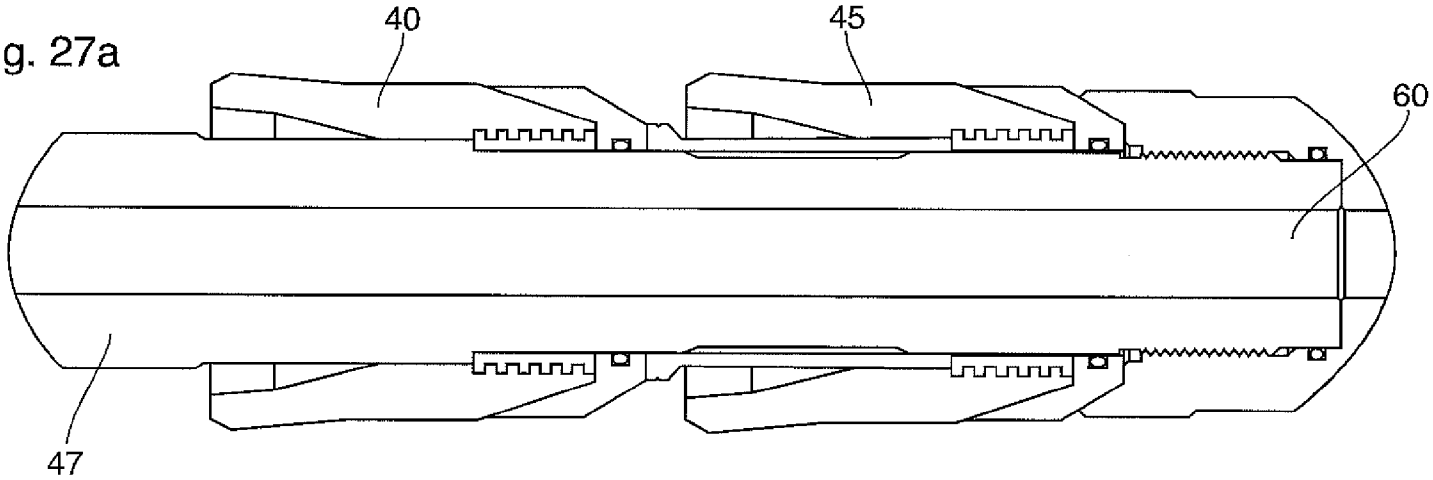
FIG. 27*a* is an enlarged view of region "B" of FIG. 1*b;*

FIG. 27*a* shows one embodiment of the upper seal member comprising a pair of cup seals 40, 45, which are positioned with the cup portion of each seal member 40, 45 thereof facing uphole, so as to permit biased thereof into sealing contact with the casing when pressurized fluid attempts to enter between the tool 10 and well casing in a region between the upper and lower ends of the tool 10 between the sealing members 40, 45 and 50.

Figure 27B:
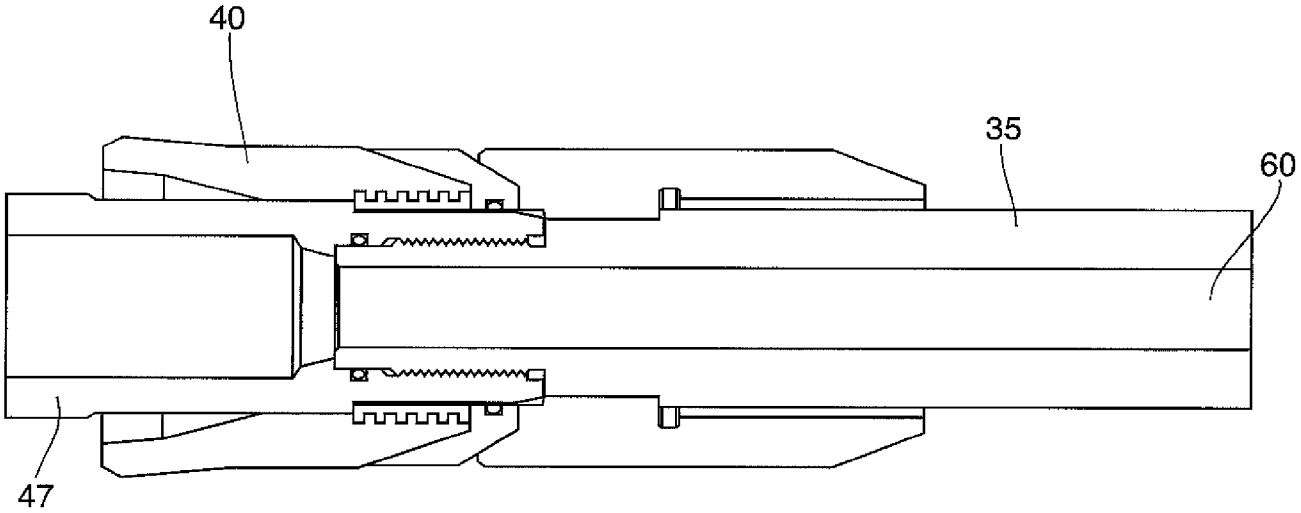
FIG. 27*b* is an enlarged view of region "R" of FIG. 22.

FIG. 27*b* shows another embodiment of the upper seal member comprising simply a single cup seal 40, but which again is positioned with the cup portion of seal member 40 thereof facing uphole so as to permit biased thereof into sealing contact with the casing when pressurized fluid attempts to enter between the tool 10 and well casing in a region between the upper and lower ends of the tool 10 between the sealing members 40 and 50.

Figure 28:
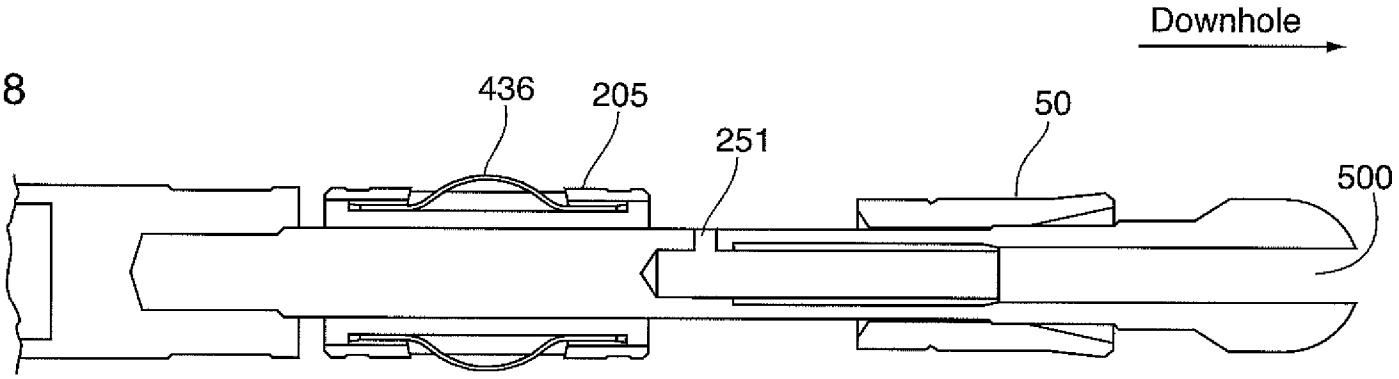
FIG. 28 is an enlarged view of region "H" of FIG. 1*b* & FIG. 16, when such tool is being lowered into the wellbore.
Figure 29:
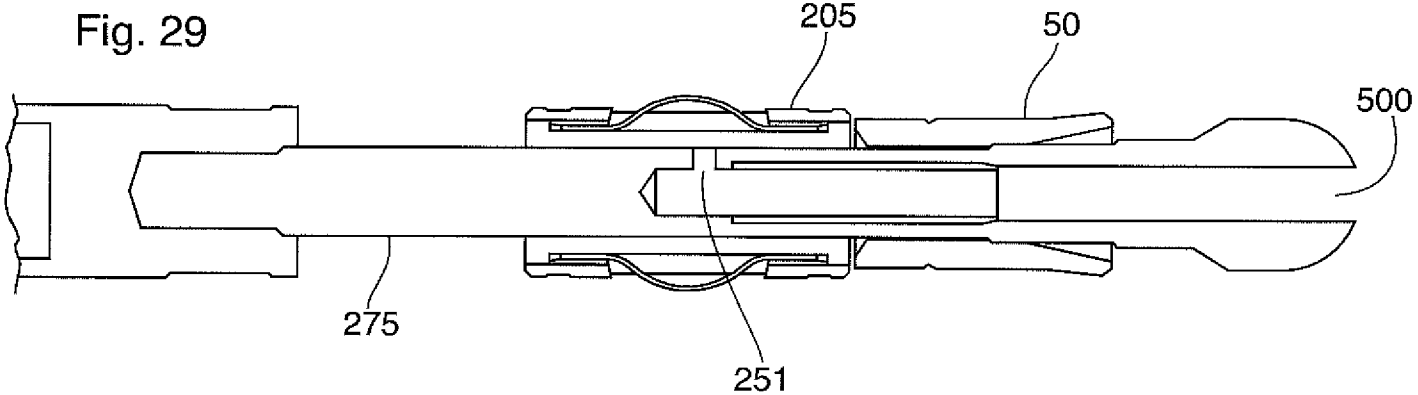
FIG. 29 is an enlarged view similar to FIG. 28, taken when such tool is in position for actuation within the wellbore.

FIG. 28 and FIG. 29 show enlarged views of the downhole end of tool 10, and in particular the manner of operation of a bypass mechanism which allows bypass of fluid around tool 10 when tool 10 is being lowered into a wellbore containing fluid. Such bypass mechanism advantageously becomes closed when the tool 10 is raised in the wellbore, thereby preventing downhole fluids in the wellbore (which may have then entered the wellbore due to earlier downhole perforating and fracking operations and which typically possess significant quantities of entrained sand) from moving uphole and entering the region of the wellbore between the tool 10 and the wellbore and potentially causing the tool 10 to become "sanded in".

Such bypass assembly on tool 10 provides for a sliding cylinder 205, positioned on mandrel 275, further having arcuate flexible spring members 436 thereon which frictionally engage the interior of the wellbore. A cup seal 50 is provided, with the cup positioned downhole to thereby permit the cup seal 50 to be biased into sealing contact with the casing when pressurized fluid attempts to enter a region between the tool 10 and well casing in a region between the upper and lower ends of the tool 10 between the sealing members 40 and 50.

In operation, when tool 10 is lowered downhole in the wellbore, sliding cylinder 205, positioned on mandrel 275, due to frictional engagement of arcuate flexible spring members 436 thereon which frictionally engage the interior of the wellbore, is caused to move uphole relative to mandrel 275, thereby opening port 251 and allowing downhole fluid which is being displaced by the lowering of the tool 10, to bypass cup seal 50 via bore 500 and pass uphole in the region intermediate the tool 10 and the wellbore, as shown in FIG. 28. Such bypass of fluid thereby allows tool 10 to be continued to be lowered in the wellbore.

Raising of the tool 10 in the wellbore, due to due to frictional engagement of arcuate flexible spring members 436 thereon which frictionally engage the interior of the wellbore, causes slidable cylinder 205 to be slidably repositioned on tool 10, wherein cylinder 205 then covers, and thereby closes port 251, as shown in FIG. 29. Accordingly, uphole flow of downhole fluid past the tool 10, which downhole fluids may have substantial sand entrained therein, can thereby be prevented.

The above disclosure represents embodiments of the invention recited in the claims. In the preceding description, for purposes of explanation, numerous details are set forth in order to provide a thorough understanding of the embodiments of the invention. However, it will be apparent that these and other specific details are not required to be specified herein in order for a person of skill in the art to practice the invention.

The scope of the claims should not be limited by the preferred embodiments set forth in the foregoing examples, but should be given the broadest interpretation consistent with the description as a whole, and the claims are not to be limited to the preferred or exemplified embodiments of the invention.

The embodiment of the invention in which an exclusive property or privilege is claimed are defined as follows:

1. A combined perforating and fracking tool for perforating a hydrocarbon well casing disposed in a formation and for subsequently fracturing the formation while maintaining the tool in situ, the tool comprising:

(a) at least one cylinder arranged to be disposed in a well casing and adapted at an uphole end to receive a delivered fluid that is delivered into the tool, said cylinder comprising a cooperating piston;

(b) a punch assembly disposed at a downhole end of said cylinder and co-operating piston, the punch assembly comprising a punch comprising a pointed piercing member for perforating the casing, wherein the punch assembly is actuated by the delivered fluid exerting an actuation pressure on the cooperating piston, and the cooperating piston exerting a force which causes outward extension of the pointed piercing member to perforate the casing;

(c) a fluid injection port disposed at an upper end of the tool to allow at least some of the delivered fluid to be injected into the formation through the perforations created in the well casing by the tool;

(d) at least one sealing member disposed proximate an upper uphole end of the cylinder, downhole of said fluid injection port, adapted to prevent fracking fluid from travelling, when such tool is in a well casing, outside the cylinder in a direction downhole; and a valve assembly disposed between the fluid injection port and said cylinder, the valve assembly actuatable between a first position and a second position, when in the first position at least some of the delivered fluid flows through the fluid injection port and wherein the punch assembly is isolated from the delivered fluid, and when in the second position at least some of the delivered fluid flows through the valve assembly for exerting the actuation pressure on the cooperating piston to actuate the punch assembly and extend said pointed piercing member to perforate the casing, wherein the delivered fluid may be provided in a bore defined along a longitudinal axis of said cylinder.

2. The combined perforating and fracking tool as claimed in claim 1, further having a plurality of cylinders and a corresponding plurality of co-operating pistons, whereby a magnification of hydraulic force is generated by the cooperating pistons to actuate said pointed piercing member.

3. The combined perforating and fracking tool as claimed in claim 1, wherein said at least one sealing member comprises a first cup seal member disposed at an upper end of said tool and a second cup seal member disposed at a lower downhole end of said tool, together adapted to prevent fluid from travelling, when such tool is in a well casing for perforating, between such two cup seal members.

4. The combined perforating and fracking tool according to claim 1, wherein the fluid injection port comprises a screen to prevent debris from entering the tool.

5. The combined perforating and fracking tool according to claim 1, wherein the at least one sealing member disposed proximate the upper uphole end of the cylinder is biased into sealing contact with the casing when pressurized fluid flows out of the injection port, to thereby prevent flow of injected fluid between the tool and well casing.

6. The combined perforating and fracking tool according to claim 1, wherein the at least one sealing member is frustoconical in shape.

7. The combined perforating and fracking tool according to claim 1, wherein a first sealing member is located downhole of the fluid injection port and uphole of the punch assembly and a second sealing member is located downhole of the punch assembly.

8. A method for perforating a well casing disposed in a formation and for subsequently fracturing the formation with the combined perforating and fracking tool according to claim 1, while maintaining the tool in situ, the method comprising:

(a) delivering a delivery fluid to the tool when the tool is disposed within a well casing, (b) actuating the valve assembly from the first position to the second position so as to flow the delivered fluid through the valve assembly to the series of connected cylinders and associated pistons whereby a combined force is generated by such pistons to actuate the punch assembly to form created perforations in the well casing;

(c) lowering the combined perforating and fracking tool to position the fluid injection port thereon adjacent to the created perforations in the well casing and to position the at least one sealing member downhole of the created perforations in the well casing;

(d) actuating the valve assembly from the second position to the first position so as to isolate the series of connected cylinders and associated pistons from the delivered fluid; and (e) pumping the delivered fluid through the fluid injection port and created perforations to fracture the formation following step (d).

9. The method according to claim 8, wherein a fluid pressure of the delivered fluid supplied to the combined perforating and fracking tool is reduced for diverting the delivered fluid so as to flow through the fluid injection port to fracture the formation.

10. The method according to claim 8, wherein the delivered fluid is supplied in step (a) at a hydraulic pressure of at least 6,000 psi.

11. The method according to claim 10, wherein pressure of said delivered fluid after step (a) is reduced to below 6,000 psi.

12. The method according to claim 8, wherein a sealing member disposed at each end of the tool forms a seal between the casing and the tool such that the delivered fluid can be diverted through the fluid injection port for fracturing the formation when the valve assembly is in the first position and wherein the tool above and below said injection port remains isolated from the injected fluid.

13. The method according to claim 8, wherein the delivered fluid is fracturing fluid.

14. The method according to claim 13, wherein the delivered fluid comprises proppants.

15. A combined perforating and fracking tool for perforating a well casing disposed in an underground formation and for subsequently fracturing the formation while maintaining the tool in situ, the tool comprising:

(a) at least a pair of cylinders arranged to be disposed in a well casing and adapted at an uphole end to receive a delivered fluid that is delivered into the tool, each of said cylinders comprising a cooperating piston, wherein each piston defines a bore along its longitudinal axis and an associated port for conducting at least some of the delivered fluid to flow from the bore into each cylinder;

(b) a punch assembly disposed at a downhole end of the cylinders, the punch assembly comprising a punch for perforating the casing, wherein the punch assembly is actuated by a piston which outwardly extends a punch to perforate the casing;

(c) a fluid injection port disposed at the uphole end of the tool, and a valve member to allow the delivered fluid to be diverted from the cylinders and injected into the formation through the perforations created in the well casing;

(d) at least a pair of sealing members respectively disposed respectively at an upper and lower end of the tool, forming a seal between the casing and the tool such that at least some of the delivered fluid can be diverted through the fluid injection port for fracturing the formation; and (e) a valve assembly disposed between the fluid injection port and said cylinder, the valve assembly actuatable between a first position and a second position, when in the first position the delivered fluid flows through the fluid injection port with said punch assembly isolated from the delivered fluid and when in the second position at least some of the delivered fluid flows through the valve assembly to communicate with said punch assembly;

wherein the punch assembly and piston each remain isolated from the injected fluid flowing between the tool and well casing during fracturing when the valve assembly is in the first position; and wherein during a perforation step when the valve assembly is in the second position at least some of the delivered fluid flowing through a bore defined along the longitudinal axis of the tool sequentially fills each of the cylinders whereby a magnification of hydraulic force is generated by the cooperating piston to actuate the punch.

16. The combined perforating and fracking tool according to claim 15, a lower of said pair of sealing members having a bypass means which may be selectively actuated to allow bypass of the lower seal only when desired.

17. The combined perforating and fracking tool according to claim 15, wherein the valve assembly comprises a valve stem operatively connected to a first piston, the valve stem being slidable when the delivered fluid entering the tool is at a sufficient pressure to increase a fluid pressure in a first cylinder of the pair of cylinders and cause the first piston to move to an open position and allow the valve stem to uncover a port which allows at least some of the delivered fluid to flow through the valve assembly and enter the bore.

18. The combined perforating and fracking tool according to claim 17, wherein the valve assembly further comprises a spring member, the spring member operatively engaging the first piston to return the first piston and valve stem to a closed position when fluid pressure is reduced.

19. The combined perforating and fracking tool according to claim 15, wherein the valve assembly comprises a spring-biased ball valve.

20. The combined perforating and fracking tool according to claim 15, wherein the valve assembly comprises a slidable sleeve having a fluid passageway, said slidable sleeve being slidable along a mandrel on the tool at a location on the tool having radial aperture therein, said slidable sleeve on its exterior having a friction member to consistently frictionally engage the casing, wherein when the tool is lowered to a desired position downhole, upward movement of the tool thereafter and resultant frictional engagement of said friction member with said casing causes relative movement of said slidable sleeve relative to said mandrel and thus repositioning of said passageway therein so as to then become in fluid communication with said radial aperture so as to cause such valve assembly to be in the second position and allow supply of at least some of the delivered fluid to downstream pistons to thereby allow actuation of said punch.

21. The combined perforating and fracking tool according to claim 15, wherein the valve assembly when in the second position the valve assembly is in fluid connection with a second piston disposed within a second cylinder and at least some of the delivered fluid is allowed to flow to fill the second cylinder whereby fluid pressure within a second cylinder of the pair of cylinders increases to cause the second piston to move therein.

22. The combined perforating and fracking tool according to claim 21, wherein the second piston is in fluid connection with a third piston disposed within a third cylinder, wherein at least some of the delivered fluid flowing through the second piston enters the third cylinder through the associated ports to fill the third cylinder whereby fluid pressure within the third cylinder increases to cause the third piston to move therein.

23. The combined perforating and fracking tool according to claim 22, wherein the third piston is a closed member having a pointed downhole end, the pointed end cooperatively engaging with the punch assembly to outwardly extend the punch to perforate the casing.

24. The combined perforating and fracking tool according to claim 23, wherein the punch comprises a pair of pointed perforating members which are forced apart by the pointed end of the third piston to outwardly extend the perforating members.

25. The combined perforating and fracking tool according to claim 24, wherein the pair of pointed perforating members are inwardly biased by a biasing member to inwardly bias the pair of perforating members and cause them to retract within the tool once the casing has been perforated and when fluid supply to the third piston has been reduced or halted.

26. A combined perforating and fracking tool for perforating a well casing disposed in an underground formation, and for subsequently fracturing the formation while maintaining the tool in situ, the tool comprising:

(a) a series of connected cylinders arranged to be disposed in a well casing and adapted at an uphole end to receive fluid that is delivered to the tool, the series of connected cylinders comprising:

a first cylinder comprising a valve assembly for controlling activation of a punch assembly, the valve assembly actuatable between a first position and second position;

a second cylinder comprising an associated piston, the associated piston being isolated from the valve assembly when the valve assembly is in the first position and in fluid connection with the valve assembly when the valve assembly is in the second position so that at least some of the delivered fluid flows through the valve assembly to the associated piston and associated ports to fill the second cylinder so that fluid pressure within the second cylinder increases to cause the associated piston to move therein;

(b) a punch assembly disposed at a downhole end of the series of connected cylinders, the punch assembly comprising a pointed punch member for perforating the casing, wherein the punch assembly is actuated by the first and second pistons to outwardly extend the punch member to perforate the casing;

(c) a fluid injection port disposed at the uphole end of the series of connected cylinders to allow at least some of the delivered fluid to be diverted from the series of connected cylinders and injected into the formation through the perforations created in the well casing when the valve assembly is in the first position; and (d) at least one sealing member disposed at each end of the series of connected cylinders, each sealing member forming a seal between the casing and the tool such that when the valve assembly is in the first position, at least some of the delivered fluid can be diverted through the fluid injection port for fracturing the formation and the series of cylinders is isolated from the injected fluid flowing between the tool and well casing;

wherein fluid flowing through the second cylinder results in a force supplied by the associated piston to actuate the punch assembly.

27. The combined perforating and fracking tool according to claim 26, wherein the valve assembly comprises a valve stem operatively connected to a first piston, the valve stem actuated to an open position when the delivered fluid entering the tool is at a sufficient pressure to increase the fluid pressure in the first cylinder and cause the first piston to move therein.

28. The combined perforating and fracking tool according to claim 27, wherein the valve assembly further comprises a spring member, the spring member operatively engaging the first piston to return the valve stem to a closed position when fluid pressure is reduced.

29. The combined perforating and fracking tool according to claim 26, wherein the valve assembly comprises a spring-biased ball valve.

30. The combined perforating and fracking tool according to claim 26, wherein the valve assembly comprises a slidable sleeve having a fluid passageway, said slidable sleeve being slidable along a mandrel on the tool at a location on the tool having a radial aperture therein, said slidable sleeve on its exterior having a friction member to consistently frictionally engage the casing, wherein when the tool is lowered to a desired position downhole, upward movement of the tool thereafter and resultant frictional engagement of said friction member with said casing causes relative movement of said slidable sleeve relative to said mandrel and thus repositioning of said passageway therein so as to then become in fluid communication with said radial aperture so as to cause such valve assembly to be in the second position and allow supply of at least some of the delivered fluid to downstream pistons to thereby allow actuation of said punch.

31. The combined perforating and fracking tool according to claim 26, further comprising:

a third cylinder comprising another piston, the another piston in fluid connection with the associated piston of the second cylinder such that fluid flowing through the fluidly connected associated piston enters the third cylinder through the associated ports to fill the third cylinder whereby fluid pressure within the third cylinder increases to cause the third piston to move therein;

wherein fluid flowing through the second and third cylinders results in a combined increase of hydraulic force generated by a series of corresponding pistons to actuate the punch assembly.

32. The combined perforating and fracking tool according to claim 31, wherein the another piston is a closed member having a pointed downhole end, the pointed end cooperatively engaging with the punch assembly to outwardly extend the punch member to perforate the casing.

33. The combined perforating and fracking tool according to claim 26, wherein the punch member comprises a pair of pointed perforating members which are forced apart by a pointed end of the another piston to outwardly extend the perforating members.

34. The combined perforating and fracking tool according to claim 33, wherein the pair of pointed perforating members are connected by a biasing member to inwardly retract the pair of perforating members once the casing has been perforated.

35. The combined perforating and fracking tool according to claim 26, wherein the fluid injection port comprises a screen to prevent debris from entering the tool.

36. The combined perforating and fracking tool according to claim 26, wherein the at least one sealing member disposed at each end of the series of connected cylinders are each biased into sealing contact with the casing when pressurized fluid attempts to enter between the tool and well casing in a region between upper and lower ends of the tool between the sealing members.

37. The combined perforating and fracking tool according to claim 36, wherein the sealing members at opposite ends of the tool are each frustoconical in shape.

38. The combined perforating and fracking tool according to claim 37, wherein a first sealing member is located downhole of the fluid injection port at the uphole end of the series of connected cylinders and a second sealing member is located downhole of the punch assembly disposed at the downhole end of the series of connected cylinders.

* * * * *